US012239181B2

(12) United States Patent
Kovarik et al.

(10) Patent No.: US 12,239,181 B2
(45) **Date of Patent: *Mar. 4, 2025**

(54) HELMET FOR REDUCING CONCUSSIVE FORCES DURING COLLISION AND FACILITATING RAPID FACEMASK REMOVAL

(71) Applicants: Carter J. Kovarik, Englewood, CO (US); Joseph E. Kovarik, Englewood, CO (US)

(72) Inventors: Carter J. Kovarik, Englewood, CO (US); Joseph E. Kovarik, Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/428,756

(22) Filed: Jan. 31, 2024

(65) Prior Publication Data

US 2024/0215676 A1 Jul. 4, 2024

Related U.S. Application Data

(63) Continuation of application No. 17/528,553, filed on Nov. 17, 2021, now Pat. No. 11,889,880, which is a continuation of application No. 16/150,550, filed on Oct. 3, 2018, now Pat. No. 11,178,930, which is a (Continued)

(51) Int. Cl.

| | |
|---|---|
| ***A42B 3/20*** | (2006.01) |
| ***A42B 3/04*** | (2006.01) |
| ***A42B 3/06*** | (2006.01) |
| ***A42B 3/12*** | (2006.01) |

(52) U.S. Cl.

CPC ..... *A42B 3/20* (2013.01); *A42B 3/046* (2013.01); *A42B 3/064* (2013.01); *A42B 3/121* (2013.01); *A42B 3/125* (2013.01)

(58) Field of Classification Search

CPC ..... A42B 3/20; A42B 3/046; A42B 3/064; A42B 3/121; A42B 3/125; A42B 3/18; A42B 3/063; A42B 3/328; A63B 71/10

See application file for complete search history.

(56) References Cited

U.S. PATENT DOCUMENTS

| | | | |
|---|---|---|---|
| 2,373,083 | A | 4/1945 | Brewster |
| 3,344,433 | A | 10/1967 | Stapenhill |
| 3,889,296 | A | 6/1975 | Martin |

(Continued)

FOREIGN PATENT DOCUMENTS

WO WO 2015/089646 A1 6/2015

*Primary Examiner* — Katherine M Moran
(74) *Attorney, Agent, or Firm* — Sheridan Ross P.C.

(57) ABSTRACT

An improved design for a helmet to reduce injuries caused by helmet-to-helmet collisions. Certain embodiments include novel quick release features that permit the detachment of a facemask from a helmet in 30 seconds or less so as to attend to an injured player in a rapid fashion. Other aspects relate to impact energy absorbing constructions employing an inner layer, an outer layer spaced apart from the inner padding layer, at least one layer that includes an array of polygonal structures, and at least one layer having a shock-absorbing elastomer, a visco-elastic polymer, an impact dispersing gel, or shape memory material. Still other embodiments include a wireless device with a sensor module coupled to the football helmet generating sensor data in response to an impact to the football helmet.

20 Claims, 22 Drawing Sheets

Related U.S. Application Data continuation-in-part of application No. 14/806,808, filed on Jul. 23, 2015, now Pat. No. 10,092,057.

(60) Provisional application No. 62/047,260, filed on Sep. 8, 2014, provisional application No. 62/031,936, filed on Aug. 1, 2014.

(56) References Cited

U.S. PATENT DOCUMENTS

| | | | |
|---|---|---|---|
| 3,900,897 | A | 8/1975 | Dunning |
| 4,012,794 | A | 3/1977 | Nomiyama |
| 4,028,743 | A | 6/1977 | Christensen |
| 4,307,471 | A | 12/1981 | Lovell |
| 4,370,759 | A | 2/1983 | Zide |
| 4,603,453 | A | 8/1986 | Yokoyama |
| 5,014,365 | A | 5/1991 | Schulz |
| 5,555,567 | A | 9/1996 | Corpus |
| 5,708,988 | A | 1/1998 | McGuine et al. |
| 5,956,777 | A | 9/1999 | Popovich |
| 5,963,990 | A | 10/1999 | White |
| 6,131,196 | A | 10/2000 | Vallion |
| 6,199,219 | B1 | 3/2001 | Silken |
| 6,292,954 | B1 | 9/2001 | Conchur |
| 6,658,671 | B1 | 12/2003 | Von Holst et al. |
| 6,700,489 | B1 | 3/2004 | Easter |
| 6,722,711 | B2 | 4/2004 | Kitzis |
| 6,879,932 | B2 | 4/2005 | Baudou et al. |
| 7,073,236 | B2 | 7/2006 | Xue et al. |
| 7,146,652 | B2 | 12/2006 | Ide |
| 7,254,843 | B2 | 8/2007 | Talluri |
| 7,328,462 | B1 | 2/2008 | Straus |
| 7,576,654 | B2 | 8/2009 | Ho |
| 7,607,179 | B2 | 10/2009 | Shih |
| 7,921,524 | B2 | 4/2011 | Maurer |
| 7,975,319 | B2 | 7/2011 | Moore |
| 8,046,845 | B1 | 11/2011 | Garcia |
| 8,079,610 | B2 | 12/2011 | Winefordner |
| 8,087,101 | B2 | 1/2012 | Ferguson |
| 8,125,338 | B2 | 2/2012 | Li |
| 8,146,178 | B2 | 4/2012 | Maddux |
| 8,196,226 | B1 | 6/2012 | Schuh |
| 8,242,910 | B2 | 8/2012 | Skjellerup |
| 8,365,315 | B2 | 2/2013 | Ortiz et al. |
| 8,528,118 | B2 | 9/2013 | Ide |
| 8,573,011 | B2 | 11/2013 | Thoonsen |
| 8,578,520 | B2 | 11/2013 | Halldin |
| 8,621,673 | B1 | 1/2014 | Pietrantonio |
| 8,636,439 | B2 | 1/2014 | Jaouen |
| 8,678,818 | B2 | 3/2014 | Dupray |
| 8,746,580 | B2 | 6/2014 | Li |
| 8,756,719 | B2 | 6/2014 | Veazie |
| 8,766,798 | B2 | 7/2014 | Howard |
| 8,800,977 | B2 | 8/2014 | Kolb |
| 8,844,066 | B1 | 9/2014 | Whitcomb |
| 8,938,818 | B2 | 1/2015 | Ide |
| 9,032,558 | B2 | 5/2015 | Leon |
| 9,516,910 | B2 | 12/2016 | Szalkowski et al. |
| 10,092,057 | B2 | 10/2018 | Kovarik |
| 11,178,930 | B2 * | 11/2021 | Kovarik ..... A42B 3/20 |
| 11,889,880 | B2 * | 2/2024 | Kovarik ..... A42B 3/046 |
| 2004/0074283 | A1 | 4/2004 | Withnall et al. |
| 2004/0117896 | A1 | 6/2004 | Madey et al. |
| 2004/0250337 | A1 | 12/2004 | Pietrzykowski |
| 2006/0127167 | A1 | 6/2006 | Wu-Hong |
| 2007/0209098 | A1 | 9/2007 | Peart |
| 2008/0155735 | A1 | 7/2008 | Ferrara |
| 2008/0163410 | A1 | 7/2008 | Udelhofen |
| 2009/0031479 | A1 | 2/2009 | Rush, III |
| 2009/0106882 | A1 | 4/2009 | Nimmons |
| 2010/0258988 | A1 | 10/2010 | Darnell et al. |
| 2011/0010829 | A1 | 1/2011 | Norman |
| 2011/0056004 | A1 | 3/2011 | Landi |
| 2011/0203024 | A1 | 8/2011 | Morgan |
| 2012/0007711 | A1 | 1/2012 | Lehnbeuter |
| 2012/0017358 | A1 | 1/2012 | Princip |
| 2012/0096631 | A1 | 4/2012 | King et al. |
| 2012/0297525 | A1 | 11/2012 | Bain |
| 2012/0306120 | A1 | 12/2012 | Li et al. |
| 2012/0326871 | A1 | 12/2012 | Lian |
| 2013/0000015 | A1 | 1/2013 | Prostar |
| 2013/0000017 | A1 | 1/2013 | Szalkowski et al. |
| 2013/0019385 | A1 | 1/2013 | Knight et al. |
| 2013/0025037 | A1 | 1/2013 | Turner |
| 2013/0036780 | A1 | 2/2013 | Valade |
| 2013/0040524 | A1 | 2/2013 | Halldin et al. |
| 2013/0061371 | A1 | 3/2013 | Phipps et al. |
| 2013/0086733 | A1 | 4/2013 | Szalkowski |
| 2013/0185837 | A1 | 7/2013 | Phipps et al. |
| 2013/0234376 | A1 | 9/2013 | Frey et al. |
| 2013/0247285 | A1 | 9/2013 | Bartsch |
| 2013/0298316 | A1 | 11/2013 | Jacob |
| 2013/0334871 | A1 | 12/2013 | Chang |
| 2013/0340147 | A1 | 12/2013 | Giles |
| 2014/0007322 | A1 | 1/2014 | Marz et al. |
| 2014/0068843 | A1 | 3/2014 | Wegener |
| 2014/0081601 | A1 | 3/2014 | Zhang |
| 2014/0090155 | A1 | 4/2014 | Johnson |
| 2014/0091933 | A1 | 4/2014 | Mohiuddin |
| 2014/0101829 | A1 | 4/2014 | Witcher |
| 2014/0115759 | A1 | 5/2014 | Tomlin |
| 2014/0133932 | A1 | 5/2014 | Davies |
| 2014/0196198 | A1 | 7/2014 | Cohen |
| 2014/0201890 | A1 | 7/2014 | Kelly |
| 2014/0208486 | A1 | 7/2014 | Krueger |
| 2014/0215693 | A1 | 8/2014 | O'Gara |
| 2014/0223641 | A1 | 8/2014 | Henderson |
| 2014/0223644 | A1 | 8/2014 | Bologna |
| 2014/0223646 | A1 | 8/2014 | Bologna et al. |
| 2014/0232530 | A1 | 8/2014 | Stewart |
| 2015/0040296 | A1 | 2/2015 | Hanson |
| 2015/0101899 | A1 | 4/2015 | Russo |
| 2015/0107005 | A1 | 4/2015 | Schneider |
| 2015/0164174 | A1 | 6/2015 | West |
| 2015/0173666 | A1 | 6/2015 | Smith |
| 2015/0305427 | A1 | 10/2015 | Prabhu |
| 2015/0305430 | A1 | 10/2015 | Rush et al. |
| 2016/0157544 | A1 | 6/2016 | Ning |
| 2016/0255900 | A1 | 9/2016 | Browd |
| 2016/0278470 | A1 | 9/2016 | Posner et al. |
| 2017/0196291 | A1 | 7/2017 | Glover |
| 2017/0196292 | A1 | 7/2017 | Reinhall |
| 2017/0196294 | A1 | 7/2017 | Fischer |
| 2017/0196295 | A1 | 7/2017 | Glover |
| 2017/0255900 | A1 | 9/2017 | High |
| 2017/0303622 | A1 | 10/2017 | Stone |
| 2018/0125144 | A1 | 5/2018 | Knight |
| 2018/0295923 | A1 | 10/2018 | Withnall |
| 2019/0232601 | A1 | 8/2019 | Kleiven et al. |
| 2020/0046058 | A1 | 2/2020 | Santiago |

* cited by examiner

TIME DELAY EFFECT OF IMPULSE [SHOCK] RESPONSE OF SELECTED MATERIALS

HELMET FOR REDUCING CONCUSSIVE FORCES DURING COLLISION AND FACILITATING RAPID FACEMASK REMOVAL

RELATED APPLICATION

This application is a continuation of U.S. patent application Ser. No. 17/528,553, filed Nov. 17, 2021 (now U.S. Pat. No. 11,889,880, issued Feb. 6, 2024), which is a continuation of U.S. patent application Ser. No. 16/150,550, filed Oct. 3, 2018 (now U.S. Pat. No. 11,178,930, issued Nov. 23, 2021), which is a continuation-in-part of U.S. patent application Ser. No. 14/806,808, filed Jul. 23, 2015 (now U.S. Pat. No. 10,092,057, issuing Oct. 9, 2018), which seeks priority from U.S. Provisional Patent Application Ser. No. 62/031,936, filed Aug. 1, 2014 and U.S. Provisional Patent Application Ser. No. 62/047,260, filed on Sep. 8, 2014. The entire disclosure of the prior applications is considered to be part of the disclosure of the accompanying application and is hereby incorporated by reference.

FIELD OF THE INVENTION

The present invention is directed to an improved design for a helmet to reduce injuries caused by helmet-to-helmet collisions, with particular embodiments including novel quick release features that permit the detachment of a facemask from a helmet in 30 seconds or less, resulting in the ability to attend to an injured player in a rapid fashion and without the need for any additional tools to accomplish such removal.

BACKGROUND OF THE INVENTION

The present invention relates to head protection methods and apparatus and, more particularly, to methods and apparatus for producing a head covering that substantially enhances the protection of the wearer in the event of a single high impact force event or repeated low impact force events where the force(s) could cause concussive injury. Various aspects of the present invention are further directed to the quick and safe removal of a facemask of a helmet to afford immediate assessment of injury and treatment thereof by an injured player.

Recent medical research reveals that concussions and cumulative head impacts can lead to lifelong neurological consequences. It is currently believed that repeated brain injuries, such as concussions, may lead to diseases later in life, such as depression, chronic traumatic encephalopathy (CTE), and amyotrophic lateral sclerosis (ALS) and early Alzheimer's. The U.S. Centers for Disease Control and Prevention, estimates 1.6-3.8 million sport-related brain injuries annually in the United States. Of these 300,000 are attributed to youth football players, some of whom die from their injuries every year—a tragedy difficult for their parents and families to recover from. The severity of the issue touching both the nation's youth and professional athletes has led to thousands of lawsuits and Congressional Hearings.

Over the past eighty years there have been significant modifications in helmet design. Yet despite advances in technology there is still debate as to whether existing helmets offer significant protection against concussion and traumatic brain injury. None of the football helmets on the market today offer what most would consider adequate protection against concussions and traumatic brain injuries.

Studies have found that the 1930s Goldsmith leatherhead helmet actually outperformed several contemporary football helmets in terms of protecting against concussion and brain injury. Teaching proper hitting and tackling techniques, promoting isometric and isokinetic cervical strengthening programs, and continued concussion awareness and education, are recommended means of protecting athletes from the consequences of concussion and traumatic brain injury. But a better helmet design is also required to reduce the incidences of injury presently experienced by athletes, especially football players.

The plastic football helmet was invented in 1940 by John T. Riddell and his son John T. Riddell Jr. Dr. Richard Schneider invented an inflatable bladder for use inside a football helmet and started mass-producing the Air™ Helmet in the early 1970s, but it was heavy and did not breath well. Rigid polycarbonate alloy plastic helmets and vinyl coated steel alloy face masks were the norm in the 1980s and 1990, as well as today. Despite reports that a more spherical designed helmet purportedly reduced the incidences of concussion by 31%, a Senate Commerce Committee in 2011 found that there was no substantial evidence to support such a finding. Most existing designs incorporate a hard, inflexible outer shell and employ various schemes to create compressive shock absorption between the outer shell and the head of the user. Most of such designs focus on spreading out impact force energy and transferring it to a pad system adjacent to the wearer's head. But helmet manufacturers are forced to design these pads to provide proper fit, thus sacrificing safety for wearer comfort and in the process, compromising the production of a helmet design that is concussion resistant.

Current helmet certification standards are based on testing parameters that were developed in the 1960s, which focus on the attenuation of linear impact and prevention of skull fracture. The focus of headgear design has always been focused on attenuating linear impact. But recent studies indicate that both linear as well as rotational acceleration plays an important role in the pathophysiology of brain injury. Although nearly every head impact has a linear component and a rotational component, rotational acceleration is greatest when a tangential blow is sustained. A football player's facemask can act like a lever arm when impacted from the side, and can therefore apply large torsional forces to the head, which can easily result in brain trauma. The emphasis and direction of helmet innovations has seemingly failed to address this issue. Various embodiments of the present invention as described herein, address it head on.

Existing designs for football helmets incorporate a hard, inflexible outer shell and employ various schemes to create compressive shock absorption between the outer shell and the head of the user, thus merely spreading out an impact force's energy and transferring it to a pad system adjacent to the wearer's head. But spreading the force over a larger area, while reducing skull fracture and reducing the force per square inch, does not, in itself, reduce the total force acting on the pad system and the users head.

In addition to linear and rotational acceleration, translational impact is another factor that has largely been discounted by helmet designers, as their focus has again been directed to attenuating linear impact. Football players sustain mild TBI mostly by translational forces because the shell of the helmet allows the players to slide relative to one another, limiting head rotational accelerations. The headgear presently employed by the NFL reduces concussion risk by using thicker and more energy-absorbing padding on the side and back of the helmets and around the ears. Thus, there is a long-felt but unsolved need to provide a helmet that, in addition to addressing the linear impacts experienced by a player, also addresses the translational and rotational acceleration of the head in an effort to reduce the likelihood of brain injury.

There is also a great and urgent need to design helmets, especially football helmets, such that their facemasks can be quickly removed/detached from the helmets in a manner that does not cause further trauma to an injured player due to the time and physical manipulation of his/her head and neck when attempting to assess the player's condition and provide treatment. There is a need for a lightweight helmet having a design that reduces the incidence of injury, that can better absorb contacts that would otherwise cause head injuries, and that further provides a way to detach a facemask from the helmet in a time-sensitive manner.

SUMMARY OF THE INVENTION

Three major advances provided by various embodiments of the present invention are: 1) PEEK comprising facemasks that provide lightweight, sturdy and yet flexible and yieldable face guards, including certain memory shape material, that can be employed to lessen blows; 2) shock absorbing assemblies provided on a helmet, preferably at least on two sides that connect with a face mask of a helmet, that lessen the brain injury potential due to helmet-to-helmet impact; and 3) the provision of quick release systems and assemblies, several employing a novel pivoting, rotating lever, which dispenses with the need for a separate tool to disengage the facemask from the helmet, so that injured layers may get medical attention in a rapid and effective fashion. Preferred embodiments incorporate one or more of these features, as well as other features as set forth herein, thereby providing a safe, lightweight helmet that significantly reduces the occurrence of concussions and brain injuries that would otherwise be encountered using prior art helmet designs.

Certain embodiments further include one or more devices for use in a system for monitoring protective headgear that includes a wireless device comprises a sensor module, coupled to the protective headgear that generates sensor data in response to an impact to the protective headgear. Preferably such module includes an accelerometer and a gyroscope such that the sensor data includes linear acceleration data and rotational velocity data. In other embodiments, a shock-absorbing helmet is provided, which has shock absorbers coupled between the helmet body and the facemask to absorb shocks upon an impact. Such a shock-absorbing helmet may include holder frames to hold shock absorbers at the helmet body, enabling the shock absorbers to absorb shocks from the facemask. Preferably, at least one shock absorber assembly (described further herein) is also employed between the facemask and the helmet securing mechanism, and still further preferred, one or more quick release elements (described herein) are employed such that the facemask can absorb blows but can still be immediately removed in the case of injury. In certain embodiments, an elastomeric shock absorber is employed that has enhanced damping characteristics and comprises a casing filled with a compressible elastomer. Various densities of elastomers may be selected to facilitate customization to reduce single direction compressive shock forces. Materials suitable for this application must be resilient, i.e. capable of withstanding shock without undue permanent deformation or rupture, and must have excellent flex life. Suitable materials may include of foamed polyurethane and vulcanized rubber, and microcellular polyurethane (MCU). For purposes of written description and without limiting the scope of the present invention, the following patents are incorporated herein by this reference: U.S. Pat. No. 5,495,923 to Bruski; and U.S. Pat. No. 4,880,087 to Janes.

In certain embodiments, the face mask is designed to avoid sticking outward from the front of the helmet beyond a certain distance, so as to avoid as much as possible the lever aspects presented with conventional football helmets when impacted from the side. Present embodiments preferably include a facemask protrusion that extends no more than 2 inches from the wearer's nose through the extent of the facemask face covering aspect.

To achieve these and other objects of the present invention, the shock-absorbing helmet comprises a helmet body, which has a receiving space for receiving the user's head and a front open side, a facemask provided at the front open side of the helmet body, and a plurality of shock absorbers mounted to the helmet body to absorb shocks upon an impact at the facemask.

Certain embodiments are directed to a shock-absorbing helmet that include a helmet body having a receiving space for receiving the user's head and a front open side; a facemask provided at the front open side of said helmet body; and at least two shock absorbers affixed to said helmet body and respectively coupled to said facemask to absorb shocks upon an impact at said facemask. The shock absorbers are preferably devoid of springs and instead employ resilient materials that are reversibly compressible but that do not present the breakage and weight issues presented by the use of spring type shock absorbers that use spring means to absorb shocks.

Even more preferred embodiments include a quick release feature that employs a clamp system for securing and unsecuring a facemask. Such a clamp system is configured to receive a facemask bar and includes a first lever having a cam surface and an opening on one end and a lever portion on an opposite end. The opening engages a first portion of a pin wherein the inwardly curved surface of the clamp engages the cam surfaces of the first lever. Still other embodiments include the use of a second lever having a cam surface and an opening on one end and a lever portion on an opposite end, wherein the opening of the second lever engages a second portion of the pin. In such embodiments, the first and second levers are independently rotatable about the pin and with respect to each other to move the clamp for securing or unsecuring the facemask. Such quick release systems are similar in various respects to quick release skewers employed in the bicycle field to connect bike seat posts, wheels to forks, etc. Such lever/cammed features are employed in various ways to reversibly secure facemask connection assemblies to a helmet such that injured players can be attended to in a far more rapid manner than is at present possible, e.g. in less than about 30 seconds for the total removal of the facemask—and without the use of outside tools, such as cordless screwdrivers, cutting tools, etc. Using such quick release assemblies in combination with other aspects of the present invention, such as the lightweight and impact absorbing facemask materials and configurations described herein, in addition to other shock absorbing assemblies that address facemask-helmet impacts, one is provided with a superior helmet that demonstrates a considerable advantage over conventional helmet designs and systems, most of which focus on padding of a user's head, rather than dealing with the absorption of impacts and the ability to quickly remove a facemask if and when a player is injured.

Quick release devices are well known in the bike industry to connect bike wheels, seat posts, etc. One aspect of the present invention is directed to use of a similar, but modified, quick release device on a helmet to connect a facemask. Various different quick release configurations can be employed, but preferably those chosen have a pivotable feature that provides the leverage required for tightening the screw that connects the helmet and facemask—without a separate tool being required. The locking mechanism preferred is either one that comprises a threaded connector or a bayonet mounted feature such that the facemask can be connected to the helmet in a quick release fashion that permits the facemask to be removed in a matter of seconds, preferably in less than 30 seconds, and more preferably in less than about 20 seconds. Such a quick release screw can connect a facemask securing platform to the helmet, preferably using just a single quick release screw on each side of the helmet. Preferably the fitting of the platform to the helmet involves the mating of certain structural conforming alignment features that allow a single screw, when sufficiently tightened, to hold the facemask securing platform to the exterior of the helmet in a secure fashion, such that significant collisions and impacts to the facemask or helmet, will not negatively affect the connection between the two. This is pictured in some of the figures where facemask bars are held in place to the helmet via a molded plastic element that presses at least two facemask bar portions to the helmet. Importantly, prior art helmets use a screw that requires a certain type of screwdriver to unscrew, thus entailing that such a screw driver be readily available when a player is injured—and that the attending persons to an injured player know how to detach the facemask without injury to the player's head and neck, in a timely fashion, etc.

Still other quick release mechanisms that may be employed in various embodiments of the present invention include those disclosed in U.S. Pat. No. 6,722,711 to Kitzis, U.S. Pat. No. 2,373,083 to Brewster, and U.S. Pat. No. 5,014,365 to Schulz, all of which are incorporated herein in their entireties. In preferred embodiments that employ a magnetically actuated facemask/helmet coupler mechanism, a notable distinction as compared to such prior art release systems is the novel combination of a locking/securing device employed in retail establishments to prevent theft of items, redirected for the use of reversibly securing facemasks to helmets so as to provide more immediate medical attention to a potentially injured player of a sport, such as football. One of skill in the art, with the guidance provided herein as to what magnetic locking/securing systems may be appropriately used in the context of helmet/facemasks connects, will appreciate that one or more of the following references, all of which are incorporated herein by this reference, can be employed: US20140208559 to Stewart; 20120326871 to Lian; 20140091933 to Mohiuddin; 20140232530 to Stewart; 20140208559 to Stewart; 2013-0036780 to Valade; 20120007711 to Lehnbeuter; U.S. Pat. No. 7,576,654 to Ho; U.S. Pat. No. 7,921,524 to Maurer.

In one embodiment, a facemask is secured to a helmet via a dynamic magnetic detacher that comprises a field source arranged to provide a first magnetic field when power is applied to the field source and a magnet arranged to provide a second magnetic field, the magnet being movable from a non-detach position to a detach position by the first magnetic field, with the second magnetic field sufficient to unlock a security tag when the magnet is at the detach position.

In other embodiments, the facemask is secured to the helmet using a magnetic clamping device for securing a facemask attachment element to the helmet, with the clamp being movable between a locked position and an unlocked position when a keyed magnetic element affixed to the clamp is activated to provide a magnetic force. In certain embodiments the clamp is movable about a pivot point such that when the keyed magnetic element is exposed to the keyed magnetic force, the clamp pivots about the pivot point from the locked position to the unlocked position. The clamp may further comprise a locking region such that when the keyed magnetic element is exposed to the keyed magnetic force, the locking region pivots about the pivot point from the locked position to the unlocked position. Still other related embodiments employ a keyed magnetic element affixed to the clamp, where the keyed magnetic element has a magnetic polarity pattern and a facemask reversibly detachable element that includes a magnetic region that applies a keyed magnetic force corresponding to the keyed magnetic element to the keyed magnet element, the magnetic force moving the clamp from the locked position to the unlocked position. The facemask reversibly detachable element has at least a portion comprised of a magnetic material such that a capture magnet may be arranged to attract the portion of the facemask reversibly detachable element.

In still other embodiments, an application is installed on a mobile communication device, such as a mobile phone, via a first short-range communication when the facemask securing mechanism on a helmet facilitates the communication of a detachment command when a player or coach or emergency response individual sends the same to facilitate quick removal of the facemask from the helmet.

Such a system may comprise at least one electronic circuit configured to provide a unique identifier to an application installed on a mobile communication device via a first short-range communication to the facemask retaining element when the facemask is attached to the helmet. A receive a second short-range communication from the mobile communication device may be received that comprises a detachment command when the facemask is desired to be removed from the helmet to actuate a detachment mechanism in response to the detachment command. The first short-range communication may be a barcode communication or a near field communication and the electronic circuit may further be configured to decrypt the second short-range communication prior to verifying that the second short-range communication is intended to be processed. Moreover, the electronic circuit may further be configured to output an audio indication or a visual indication indicating that the detachment mechanism has been actuated. The electronic circuit may further be configured to automatically secure the facemask to the helmet when a pre-defined time period expires.

One embodiment is directed to a football helmet having an inner shell that is more rigid than an outer shell, with the outer shell being more flexible than the inner shell and the football helmet having at least one layer that includes an array of impact absorbing polygonal structures proximate to the outer shell and proximate to the inner shell, with such at least one layer providing resistance to an impact force. The at least one layer may include one or more of the following materials: thermoplastic polyurethane, an impact absorbing silicone, an energy-absorbing foam, a polymer gel, a shock-absorbing elastomer, a visco-elastic polymer, an impact dispersing gel, and shape memory material. The football helmet's facemask has a facemask bar portion connected to the football helmet by at least two quick release facemask connecting structures positioned on at least a left side and a right side of the football helmet. The facemask connecting structures may include a coupler mechanism adapted to receive a facemask bar portion to secure the facemask bar portion to the helmet. The coupler mechanism may have a contoured plastic exterior with a metal post movably retained in an interior of the coupler mechanism by a magnetically actionable locking assembly adapted to move from a first locked position to a second unlocked position when a magnetic force is applied to the contoured plastic exterior. Application of the magnet to the contoured plastic exterior causes the metal post to move from a retained position to a non-retained position that allows for detachment of the facemask bar portion from the helmet. In a preferred embodiment, the magnetically actionable locking assembly has no rotating parts.

In certain embodiments, the facemask securing assembly includes a housing and a locking mechanism disposed within the housing, with the locking mechanism including a detaching element configured to unlock the facemask from the helmet, with the locking element further having a feedback element configured to generate haptic feedback when energized if the facemask securing assembly has been unlocked by the detaching element. Preferably the feedback element is a vibrating element or a visual indicator.

Other embodiments include a facemask/helmet detacher system that includes a field source arranged to provide a first magnetic field when power is applied to the field source and a magnet arranged to provide a second magnetic field. The magnet is movable from a non-detach position to a detach position when exposed to the first magnetic field. The second magnetic field is arranged to unlock a facemask securing element when the magnet is at the detach location. The system may further include an activation device that includes a processor configured to trigger power to be supplied to the field source.

Still other embodiments include a facemask magnetic detacher having a magnet assembly that provides a magnetic field sufficient to disengage a clamping mechanism within a hard plastic housing, employing first, second and third magnets, with the third magnet having a top surface substantially coplanar with a top surface of both the top surfaces of both the first and the second magnets, preferably including permanent magnets, such as an NdFeB magnet, a hard ferrite magnet, an SmCo magnet, and an AlNiCo magnet.

Yet other embodiments employ a facemask release mechanism that consists of a multiplicity of permanent magnets in the form of a Halbach array disposed on a plane, with a highly magnetized top side of the release mechanism covered by a cover plate. The permanent magnets preferably include a self-contained frame magnet that is magnetized in an axial direction and has a first recess. Inserted in this first recess is a segmented magnet, wherein the individual segments are magnetized perpendicularly to the magnetization direction of the frame magnet and a second recess is left open, in which an axially magnetized magnetic core is inserted.

Other embodiments involve a more direct connection between the facemask bar structure and a quick release securing element, such embodiments involving an enclosing element that encircles or covers portions the facemask bar in a retaining fashion, which is then tightened by the rotation of the quick release lever. The quick release mechanism preferably has a further structural feature that connects directly to the helmet surface. In some embodiments, a screw or bayonet feature is employed to both tighten the structure around the facemask bar, as well as secure the facemask bar to the helmet surface itself. To enable the desired quick release function in such arrangements (i.e. where the single quick release structure achieves both the connection of the facemask to the quick release device, as well as the connection of the quick release device to the helmet), the facemask encircling structure is constructed and designed in a fashion that permits removal of the facemask by physically pulling the facemask bar out of the structure. Thus, in some embodiments, the facemask encircling structure is comprised of two convex shaped members shaped to cradle the facemask bar therebetween, and thus, when moved into close relationship with the facemask bar is in such cradled structure, such as when the quick release screw is tightened. Several embodiments involve the ability to rotate the securing elements via a magnetically activated device, such that the facemask can be removed from the helmet by use of a device similar to that employed in retail establishments where a magnetic detacher system is used to reversibly attaché hard magnetic tags to clothing.

In still other embodiments, however, a simpler retrofit embodiment of the present invention involves the replacement of existing screws in helmets with a properly sized and configured quick release screw assembly of the present invention, thus providing a way to provide lifesaving, rapid removal of a facemask without the need for special tools, such as cordless screwdrivers, cutting tools, etc. Such a quick release assembly includes a screw body that has a pivoting head at one end, adjacent to a helmet contacting washer that when the screw is positioned on the helmet and tightened, contacts the exterior of the helmet. The other end of the screw, which is approximately just longer than the width of the helmet material through which the screw is passed through, has a blunt end that is designed so as not to abrade or injure a player's face or neck region, and is preferably smooth and flat, such that it is in close contact to the interior surface of the helmet when the screw is tightened.

A certain embodiment of the present invention involves the employment of a helmet having integral facemask securing elements that are securely positioned at places on each side and/or on the forehead regions of the helmet such that a facemask can be reversibly secured to the helmet by placing the facemask bar into, e.g. between the rotatable bar-shaped members, so that the facemask securing structures, upon rotation of such securing structures, results in the facemask being entrapped in a secure position on the helmet. Thus, when the rotating features are in a facemask bar receiving position, twisting or rotating of one or more of the rotating structures enables the securing structures to at least partially cover the facemask bar so that the portion of the facemask bar is largely covered by such structures and thus secured to the helmet. As described herein, such a helmet to facemask closure member can have a conformation such that once closed over the top of the facemask bar, the bar is frictionally forced against the floor of the slot opposite the closed member side of such securing structure. In such a manner, portions of the facemask bar are enclosed and securely held in place by the rotated members.

Still other embodiments employ a quick release lever as described herein in combination with existing helmet quick release mechanisms. For example, Riddell has a QR system that requires a separate tool to operate the quick release function thereof. An advancement provided by the present invention involves the modification of such system to structurally include a pivoting lever that can screw the threaded shaft into and out of engagement without the need for a separate tool.

In preferred embodiments, the face mask design employed comprises polyaryletheretherketone, PEEK. In other embodiments, it is a memory shape material, such as the PEEK Altera™ material. While still other lightweight, plastic or composite materials can be used to form the majority of a facemask, PEEK is superb material that has long established its durability, strength and protective capabilities in the medical device marketplace. Replacement of steel and heavy metal facemasks, especially for high school and younger football players, is especially called for, due to the morphology differences between such individuals as compared to pro-athletes who have more developed neck muscles. Youth and adolescent players have large heads on a slender neck and less strength-to-area for their neck musculature. The youngest subjects not only have a relatively large head on a relatively thin neck, but their neck is also weaker for the same cross-sectional area. Therefore, while youth and adolescent football players have comparable head size to reported mature norm values, their neck size, MOI, isometric force application, and peak resistive torque developed at the C7 vertebra are only a fraction of the corresponding mature norm values. Helmet mass comes from 3 areas (about a third each for the facial and mandibular protector, shell, and padding). One objective of the present invention is to reduce weight whilst maintaining protectivity.

Current helmet shells are made from polycarbonate or ABS plastic. These materials are selected mainly for their durability under repetitive impact loading. However, polycarbonate and ABS do not provide maximum energy absorption, as they absorb only 6% to 14% of total work energy during deformation. Moreover, it is an unfortunate truth that the shell thickness of youth helmets is a function of the reconditioning process, as reconditioned football helmets are sanded down after each season and their surfaces refinished to achieve the 10-year expected lifespan of a youth helmet. Hard materials like polycarbonate and ABS lack optimized energy absorption. In contrast, PEEK is a durable, softer material that can attenuate energy (lower peak acceleration with longer contact duration) during a head-to-head contact better than currently used polycarbonate or ABS helmets. Unfortunately, current commercially available designs all utilize rigid protector-helmet constructs, and lack the combination of features of a truly quick release facemask, with a PEEK construction and including a shock absorbing assembly to reduce the incidence of concussions and brain injury. If the present invention in these embodiments were implemented, there would be provided a lighter and lower profile helmet with increased energy attenuation. Added weight creates fatigue in the user and increases inertia to the head in collisions. As one of the heaviest portions of today's football helmets is the facemask, often mounted such that it extends considerably beyond the nose of the player, it is also important (e.g. to reduce the lever-like action caused by the facemask during a collision), to reduce the dimensions and weight of such facemasks. The facemask acts like a lever when being impacted and to minimize the same, certain embodiments of the present invention employ a facemask that is no more than two inches from the nose tip of a wearer, more preferably between about 1.5 inches and 1.8 inches of the nose tip.

The present inventors contend that oblique impacts present even longer impact durations and are the reason seemingly innocuous impacts cause increased incidences of concussion. As a direct teaching away from the market forces that seek ever harder and stronger helmets, one aspect of the present invention is directed to the employment of softer football helmets, specifically comprising PEEK, to enhance protection against both traumatic head and brain injuries. In other embodiments, a helmet employs structural components that are designed and adapted to slide relative to each other, such as via a shock absorber assembly, providing impact force energy dissipation. One objective is therefore to achieve impact force attenuation sufficient enough to prevent concussive brain injury or chronic traumatic encephalopathy (CTE).

Yet another feature of certain embodiments of the present invention relates to provision of one or more indicators of prior structural impacts to the helmet. Such indicators can be employed to permit a player and coach to later assess such impacts to determine whether one or more recent impacts to the helmet deserve further scrutiny as to the player's physical wellbeing after experiencing such impacts. Such indicators, which can be communicated directly to smart phone devices, analyzed via an injury assessment program, etc., and can thus assist coaches and players in deciding how best to protect the athletes from experiencing brain injuries sought to be avoided. After an accident, protective helmets often times appear to be intact outwardly but because they have had to absorb large amounts of energy, they may not be. In various embodiments of the present invention, an indicator is provided that discerns whether the helmet has recently experienced one or more of a linear, translational or rotational energy that could potentially be detrimental to the wearer of such helmet; that records the duration, severity and/or number and degree of impact events so that proper player participation and safety can be assessed with objective criteria.

In addition to football, there are many human activities that, due to the size and speed of the participants (and their respective competitors) coupled with a more injury-inducing environment, have increased the likelihood of serious brain injury. While the present disclosure admittedly is focused on a football helmet, one of skill in the art will appreciate the teachings as applied to other sports and activities where helmets are employed, e.g. hockey, baseball, tank operator, race driver, snow mobile operator, motorcycle operator, and the like. In all of these contexts, one objective of the present invention is to attenuate an impact force in a manner sufficient enough to prevent concussive brain injury or chronic traumatic encephalopathy (CTE).

Another aspect of the present invention relates to the easy removal of a facemask under several conditions, including the unfortunate event of an injury to a player where the removal of the face mask must be performed quickly and without further risking injury to a player's spine by the unnecessary further manipulation of the neck and spinal region. Today's helmets often require one or more tools to dissociate a facemask from a helmet and there is concern that emergency responders may not be properly trained in the removal of such facemasks and/or may lack appropriate tools to remove such facemasks, when a player is visited on a field of play, especially at night and under pressured group situations. One aspect of the present invention relates to the provision of a helmet that does not require any specialized tool, nor even a screwdriver, to quickly remove the facemask form the helmet. Thus, one aspect of several embodiments relates to facemask retention elements employed to reversibly attach and remove a facemask from a helmet. Preferably the complete extraction of the facemask from the helmet is achieved in less than 30 seconds. This may be accomplished in several of the embodiments disclosed herein via the simple twisting of locking levers that secure the facemask to the helmet. The present state of most existing helmets having associated facemasks requires that a set of extraction tools be available so that proper and efficient removal of the facemask can be achieved. Such tools are often not available on a moment's notice, nor are they always carried by emergency responders, let alone a football coach. Such tools may presently include an anvil pruner, a cordless screwdriver, an FMextractor, a trainer's angel, etc. Effective use of some of these tools is dependent upon the hand strength of the individual using such tools. Often there is a fair degree of manual dexterity required to quickly sever or disconnect the facemask joining elements from the helmet in a fashion that does not cause still further trauma to the player. The use of necessary tools to remove the facemask is rendered even more difficult due to the interference experienced by a player's shoulder pads, thus further extending the critical time components involved in providing care for an injured player without him/her suffering additional pain and injury. Employing the present invention, however, there are one two or at least three facemask securing points on the helmet that employ a truly quick release facemask cage-connecting system to extract the facemask in less than 30 seconds. With the present invention, a person detaching such connection points need not have familiarity with the more complex facemask removal tools and systems now used in order to quickly achieve detachment of the facemask. Everything that one requires to rapidly remove the facemask is present on the helmet itself.

It is also preferable to fully and completely extract the facemask from the helmet, rather than merely retract the facemask, e.g. by detaching the lateral connection points and leaving the forehead connector in place, which in some embodiments would permit pivotal rotation of the facemask without detachment fully from the helmet. One particular advantage of certain aspects of the present invention is that existing helmets can be retrofitted with the easily detachable facemask connection and securing mechanisms disclosed herein. Thus, while the other preferred embodiments of the invention involve the use of structural and functional components to reduce the injuries suffered by players wearing helmets (e.g. PEEK, shock absorbers, etc.), the facemask connector elements of the present invention can be employed with a wide variety of past, present and future helmets. In particular, the facemask connecting structures of the present invention can readily be used to retrofit existing helmets.

In a particular embodiment, a rotatable, facemask retaining feature is employed to achieve rapid reversible engagement between a helmet and a faceguard. In one form, a facemask connecting structure is provided which has a rotatable member that is designed to receive and to restrain a portion of a facemask bar. Once a facemask bar is placed inside a slot in the center of the rotatable member, the rotatable member can be turned or rotated to a closed position, whereby the facemask portion is secured via one or more retaining members that rotate to fit over the top of the facemask bar portion. For example, a simple twisting motion can be employed to reversibly secure a facemask to a helmet. In one embodiment, the rotatable member is rotatable in a first direction (e.g., counterclockwise) relative to a body of the facemask securing element for securing or locking the facemask bar portion within the slot, and for rotating in an opposite direction (e.g., a clockwise direction) relative to the facemask securing element body for unsecuring or unlocking the facemask so that it is substantially unrestrained from exiting the slot. To facilitate twisting of the elements, various finger conforming features can be provided on the rotatable elements such that a player, a coach or an emergency responder can readily contact the rotatable members and rotate them into an unsecured position.

The rotatable member may include one or more slot coverable extensions of various shapes and sizes and such extensions can be rotated into (or more accurately—over the top portion of) the slot opening. A facemask portion (e.g. a section of a bar of a facemask near the sides of the facemask that correspond to the opposite sides of a football helmet.) The facemask bar can be inserted into the opening of the rotatable retention structure when in its open position and the retaining overlying structures can be rotatably moved to secure the facemask bar within the slot. Such facemask bar can also be removed from the facemask securing element slot via this opening via simply turning the structure so as to present an open slot where the retaining member(s) of the bar have been moved (e.g. rotated) out of the retention position. In particular, such facemask retaining extensions, when rotated to occlude at least a portion of the slot opening, thereby preventing a facemask bar that is residing in the facemask securing element slot from exiting therefrom, and when rotated out of the slot opening, these extensions do not prevent the facemask from being readily removed from the facemask securing element slot. In one or more embodiments, such coverable extensions may be C-shaped, bar shaped or any other shape that accomplishes the goal of permitting the facemask bar to be placed into the open slot, and then retained in such slot via rotation of the retaining element to secure the facemask in such slot. Such slot coverable extensions may be straight or bar shaped, such extensions may be parallel to one another, or such extensions may be generally irregularly shaped. Additionally, such extensions may include one or more notches that can be accessed by a tool for rotating the rotatable member. Preferably, however, the need for a separate tool to rotate the securing feature, and thus reversibly engage the facemask to the helmet, is avoided by providing topical features that facilitate manual twisting/rotation of the closure elements. Preferably, a manually twisting feature is provided such that the reversible securement of the facemask to the helmet can be achieved.

In one or more embodiments, the rotatable member may include two opposing columns attached to opposing sides of the circumference of the cylindrical portion, wherein such columns extend away from their attachment to the cylindrical portion such that they extend out of the cylindrical recess for attaching to the one or more rotatable extensions described herein. The attachment of the columns to opposing sides of the cylindrical portion allow for the insertion of a portion of a facemask between the columns so that the portion can reside in the retention slot. More specifically, although the columns extend above the side walls of the slot, the columns do not interfere, regardless of the rotation of the rotatable member (relative to the body). In particular, the columns may rotate (when the rotatable member rotates) about a central axis of the cylindrical recess, and rotate within a confined angular range.

In one or more embodiments, the rotatable member and the cylindrical recess may include various features for rotatably securing the rotatable member within the cylindrical recess to that a facemask is substantially prevented from disengaging from the helmet. Such features may include mating combinations of projections and recesses such that a projection (or recess) may be provided on the cylindrical portion and/or the columns for mating with a corresponding recess (or projection) of an interior wall of the cylindrical recess for locking the rotatable member therein while also allowing it to rotate therein. Note that such mating projections and recesses may be, respectively, ridges and grooves.

Also, note that the cylindrical recess may include additional features or mechanisms that prevent the rotatable member from freely rotating within the cylindrical recess. In one or more embodiments, a circular cross section (perpendicular to the central axis of the cylindrical recess) may be slightly out of round in various places to frictionally engage adjacent surfaces of the rotatable member for assisting in maintaining the slot coverable extensions in one or more predetermined orientations relative to the slot. In one or more embodiments of the facemask securing element, the cylindrical recess and the rotatable member may include interlocking elements that substantially restrict the rotation of the rotatable member to discrete and predetermined angular orientations about the central axis. Such interlocking elements may provide a ratchet mechanism, or alternatively interlocking shapes wherein a first shaped element (e.g., on the cylindrical portion of the rotatable member or a wall portion of the cylindrical recess) mates or interlocks with compatibly one or more shaped elements (on the other of the rotatable member or a wall of the cylindrical recess) dispersed at discrete angular positions about the central axis for restricting rotation of the rotatable member from one of these positions to another. Note that such interlocking elements may allow the rotatable member to rotate in both a clockwise and a counterclockwise direction when a sufficient predetermined directional force(s) is applied for disengaging the interlocking elements from a first position and interlocking at a second position.

In one or more embodiments, the strength transmitted to the free ends of the slot coverable extensions for covering the slot is partially derived from the circular shape of the attached cylindrical portion and the intimate fitting of this cylindrical portion of the rotatable member within the cylindrical recess. In one or more embodiments of the slot coverable extensions, the side thereof facing the facemask securing element body may include features or elements for engaging with the facemask securing element body adjacent the slot for assisting in holding such extensions in a "closed" position (i.e., where the extensions span or at least partially cover a width of the slot opening thereby preventing, e.g., a facemask bar from exiting the slot), or in an "open" position (i.e., where the extensions do not span or interfere with the slot opening in a manner that would prevent a facemask bar from entering or exiting the slot). In particular, such an underside may include one or more protrusions for mating with a corresponding depression in the facemask securing element body adjacent the slot.

In one or more embodiments of the facemask securing element, the slot coverable extensions can be configured so that in at least one rotatable position such extensions cause or induce retention of the facemask in the slot to be "actively" held in place within the slot. Preferably, the rotating retention features described herein are relatively flush with the exterior surface of the surrounding helmet, such that the risk of disengagement of the facemask from the helmet due to an impact collision, is minimal.

The rotation of the covering members over the top surface of the facemask bar can thus force the facemask portion into contact with the surfaces of the slot (e.g., a floor of the slot) with sufficient force to induce frictional forces therebetween such that such frictional forces effectively inhibit movement of the facemask, including in a direction along the length of the slot. Additionally/alternatively, the slot coverable extensions can be configured so that in at least one rotatable position such extensions cause or induce a portion of the facemask in the slot to be "passively" held in place within the slot. The facemask securing element disclosed herein may be comprised of metal, plastic or ceramic or combinations thereof although equivalent materials also may be used. Metal injection molding (MIM) technology can be used for manufacturing components of the facemask securing element, including the facemask securing element body which provides features for rotatably securing the rotatable member to the helmet. The size of the structures will be somewhat dependent upon the size of the facemask bars at issue, but as there is some consistency in the present football facemask field, the rotatable retention elements are sized to accept such conventional sized bars within the slot of the retention device.

Restraining wedges attached to the slot facing side of each of the extensions may be employed to exert a force(s) for pressing the facemask portions against the slot floor.

Cover extensions (e.g. that rotate to entrap the facemask portions) may be irregularly or uniformly shaped to be compatible with a separate tool (e.g. a screw driver) or a ratchet for grasping the rotatable member for rotating the rotatable member. Thus, while certain embodiments of the present invention are directed to assemblies where a separate tool, such as a screwdriver, is not required, other embodiments include the prospect that a screwdriver of similar tool (even if it is a coin that can be used to insert into a groove to effect rotation of the rotating enclosure elements described herein) may be used to facilitate reversible securement of the facemask to the helmet. An increased length of the slot being covered by the extensions assists in maintaining a desired alignment of the facemask portions to the bracket.

The columns of the rotating elements may also include a locking tab for engaging (and entering into) notches defined by pairs of closely spaced ridges distributed about the circumference wall of the recess. Thus, the locking tabs act to further restrict the rotation of the assembly after it is in a closed position, entrapping the facemask portion in a secure arrangement with the helmet.

In still other embodiments, the helmet can further employ sliding materials as part of the helmet construction, thus addressing the impacts encountered in contact sports by having the impact energy absorbed by the sliding shells. Incorporated herein by this reference is U.S. Pat. No. 4,307,471 issued to Lovell, which discloses a protective helmet assembly made up shells that slide relative to each other providing impact force energy dissipation via lost motion.

Another feature of various embodiments of the present invention involves the strong correlation of concussion with translational acceleration as the primary measure for assessment of the performance of helmet protection systems. Thus, in certain embodiments of the invention, both translational and rotational acceleration are addressed to limit injury to a player. Another aspect of certain embodiments is the importance of addressing injuries caused by the facemask being impacted at an oblique angle, with the majority of contacts occurring below the head's center of gravity. Certain segments of the helmet show higher risks for concussion, particularly low on the side and back and oblique to the face mask. The particular facemask shock absorbing configurations and the use of PEEK as the material for facemasks (e.g. the weight reductions and impact attenuation achieved via the present invention, is believed to substantially reduce the injuries attendant to the collisions inherent in many contact related sports.

The present invention generally relates to impact energy attenuation, and particularly to facemask construction, design and attachment systems and assemblies intended to reduce trauma resulting from impacts to parts of the body, such as the head. While the present invention relates specifically to football helmets, it should be understood to be applicable and directed to other fields in the general personal protection field. As such, as one will appreciate, it has wide application and can be used in every kind of helmet from baby helmets to military helmets, and for all athletes at risk of concussion and head injuries such as football players, cyclists, skiers, snowboarders, skateboarders, hockey players, baseball players, lacrosse players, boxers, soccer players, equestrian/horse-riding sports, such as polo and horse racing, as well as motorcycle and race car drivers.

In other embodiments, certain aspects of the present invention relate to a superior helmet construction, which in concert with one or more of the features set forth herein (e.g. the quick release facemask assemblies, shock absorbing assemblies, armadillo-like surfaces, etc.) one is able to construct a helmet that has superior and unprecedented safety attributes, especially as it relates to reducing the occurrence of concussions. In other words, conventional helmets lack various structural and functional aspects of the present invention, including but not limited to the use of lightweight helmets and facemasks, shock absorbing systems that connect facemasks to the helmet, the use of quick release threaded connectors between the facemask and the helmet, unique helmet constructions that employ various features derived from nature, including particular preferred helmet designs that incorporate structural features of an armadillo shell (particularly the South American species having three rings), the use of specialized shock absorbing polymers and composites (such as Sorbothane®) in conjunction with other structural armadillo-derived features; and quick release systems that either include rotatable self-ligating features that reversibly attach a facemask to a helmet, and/or a magnetic locking system that employs structures and features derived from theft-prevention systems common in the retail clothing industry.

Various embodiments of the present disclosure are set forth in the attached figures and in the detailed description as provided herein and as embodied by the claims. It should be understood, however, that this Summary section may not contain all of the aspects and embodiments claimed herein. Additionally, the disclosure herein is not meant to be limiting or restrictive in any manner, and is directed to be understood by those of ordinary skill in the art. Moreover, the present disclosure is intended to encompass and include obvious improvements and modifications of embodiments presented herein. Additional advantages of the present disclosure will become readily apparent from the following discussion, particularly when taken together with the accompanying drawings.

DETAILED DESCRIPTION OF CERTAIN EMBODIMENTS OF THE PRESENT INVENTION

Figure 1:
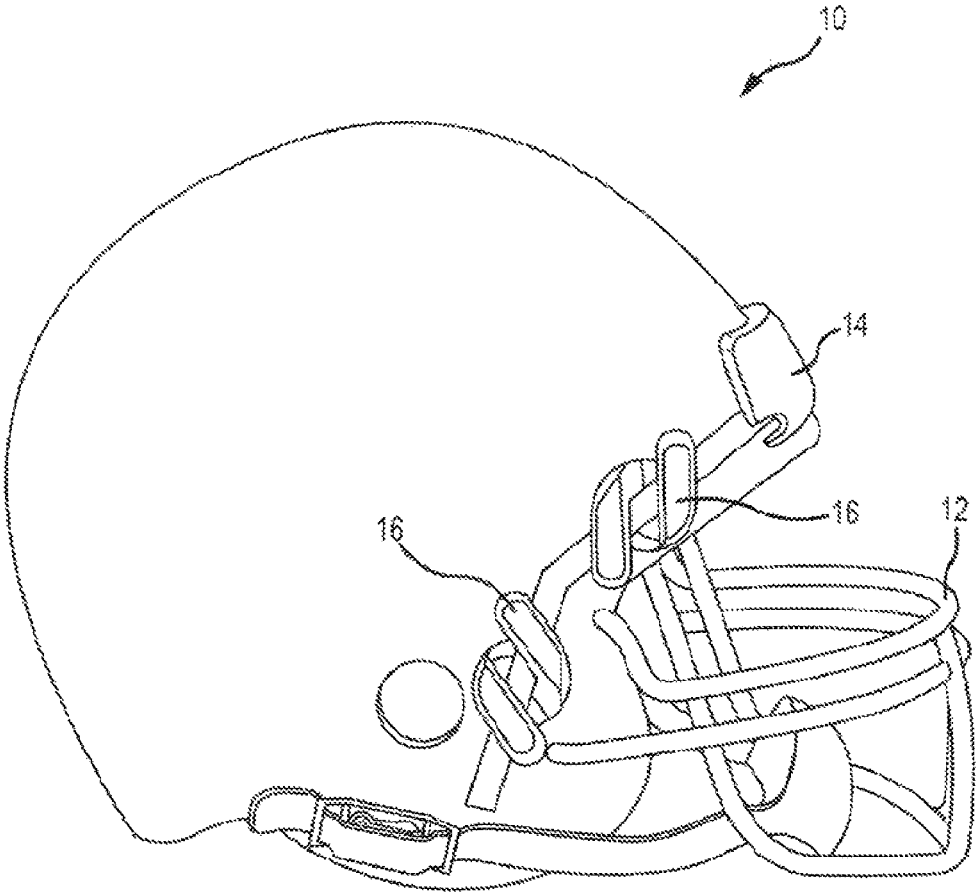
FIG. 1 is a side perspective view of one embodiment where a plurality of rotating facemask securing assemblies are shown.
Figure 2:
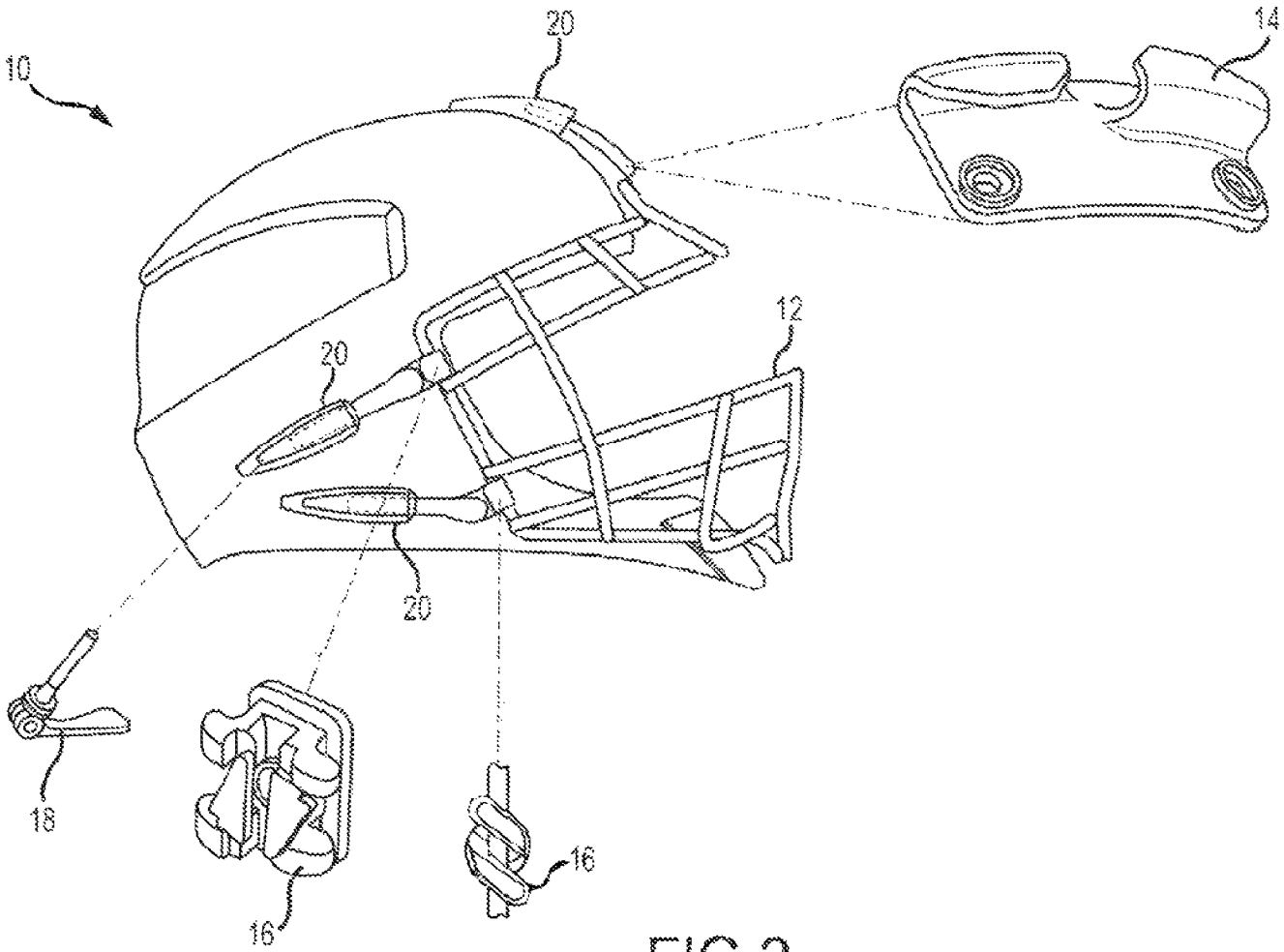
FIG. 2 is a side perspective view of another embodiment where rotating facemask securing assemblies are connected to various different portions of a helmet to secure a facemask in a quick release fashion.
Figure 3:
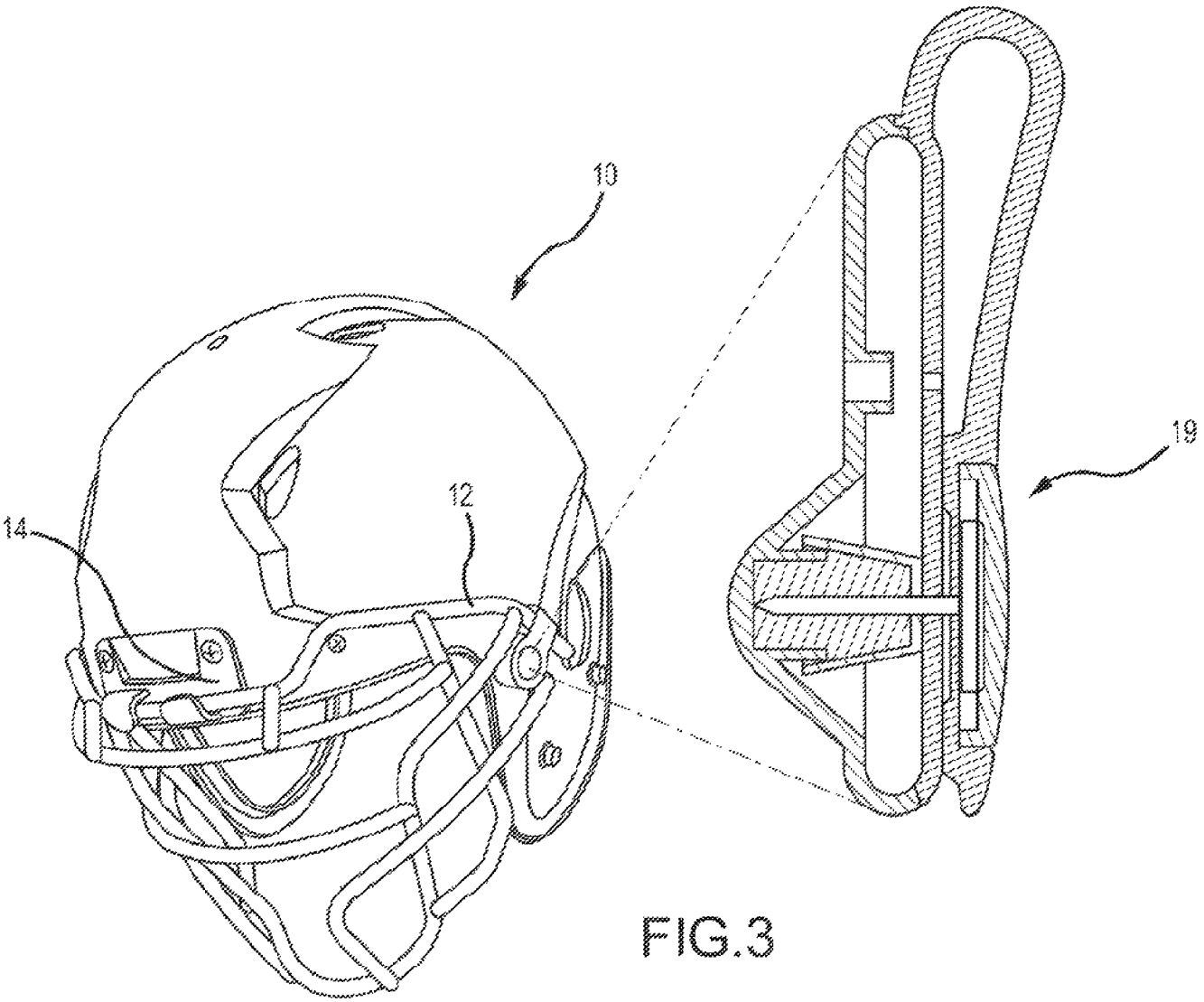
FIG. 3 is a partial perspective view of a helmet showing a quick release assembly in exploded view.
Figure 4:
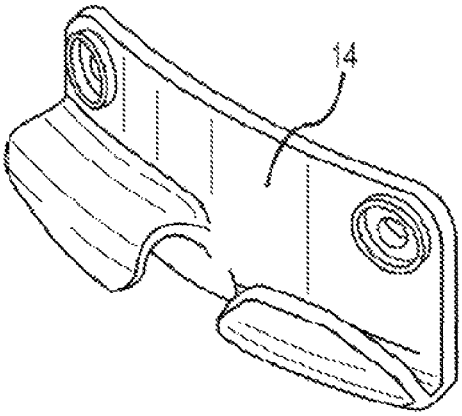
FIG. 4 is a perspective view of one embodiment of a forehead connection element that can be employed in concert with other quick release assemblies of the present invention.
Figure 5:
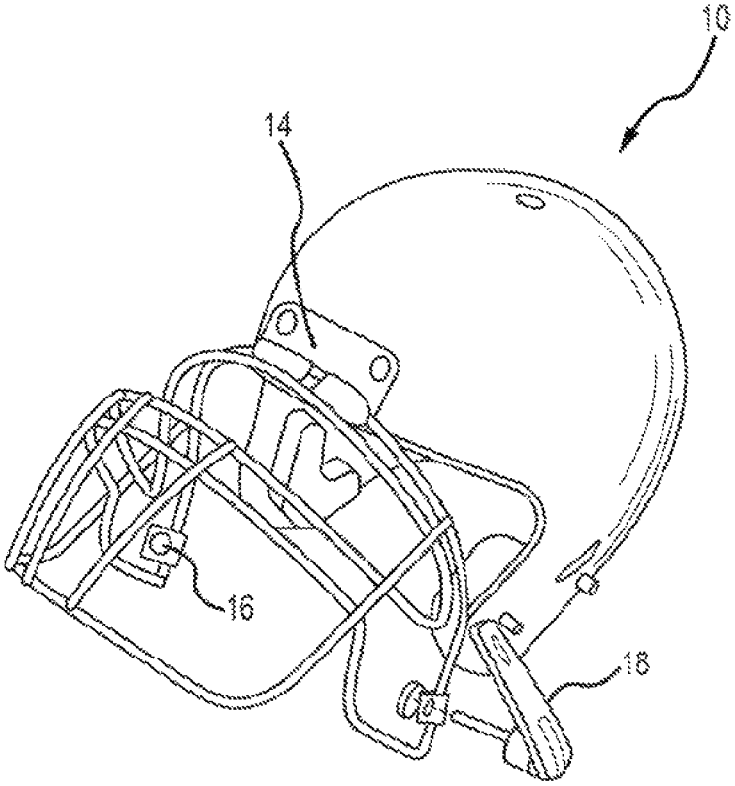
FIG. 5 is a side perspective view of an embodiment where a quick release assembly is shown in a detached from the helmet position, with the forehead connection element pivotally retaining the facemask.
Figure 6:
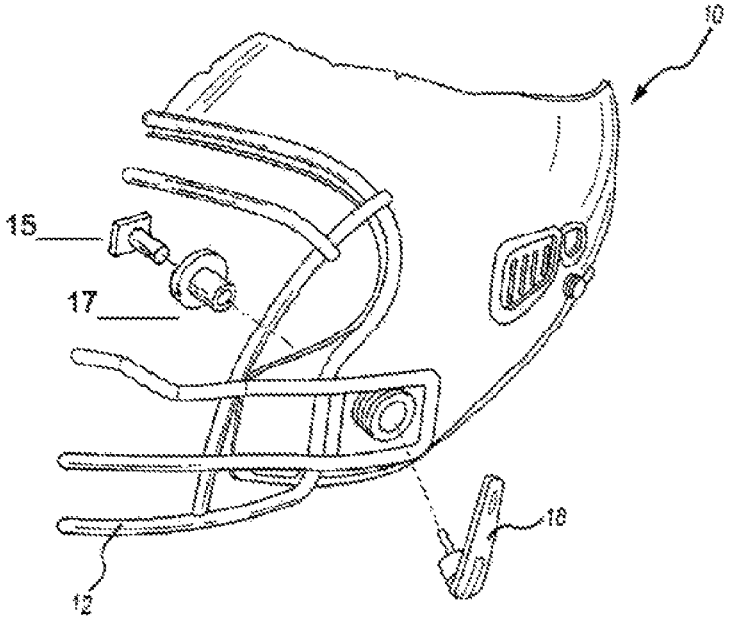
FIG. 6 is a partial perspective view of another embodiment of a facemask and helmet design where a quick release lever is shown in exploded view, with an exterior pivoting lever connectable to an interior assembly of connection elements.
Figure 7:
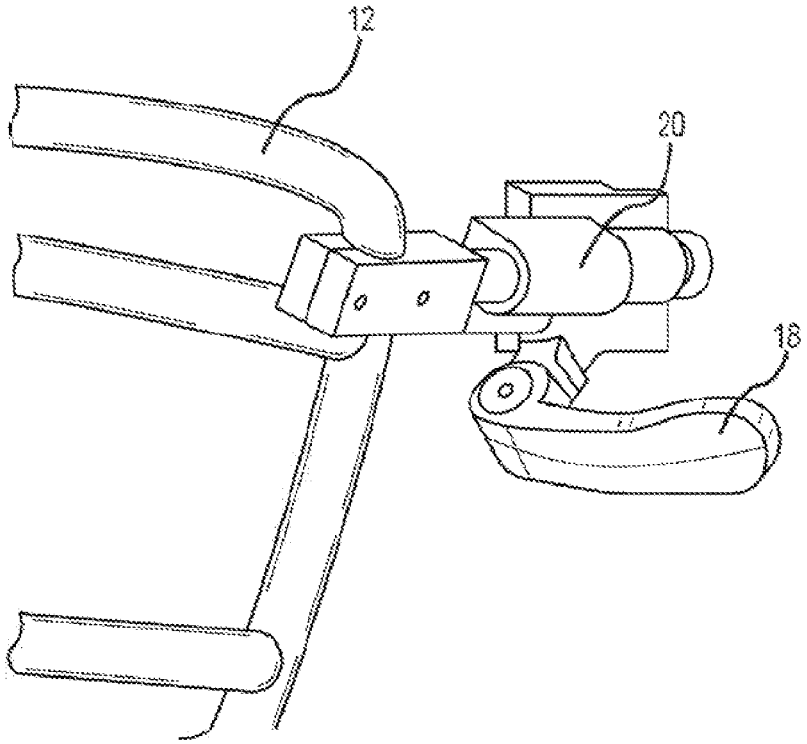
FIG. 7 is a partial close-up view of one embodiment of a facemask shock absorbing assembly associated with a quick release assembly.
Figure 8:
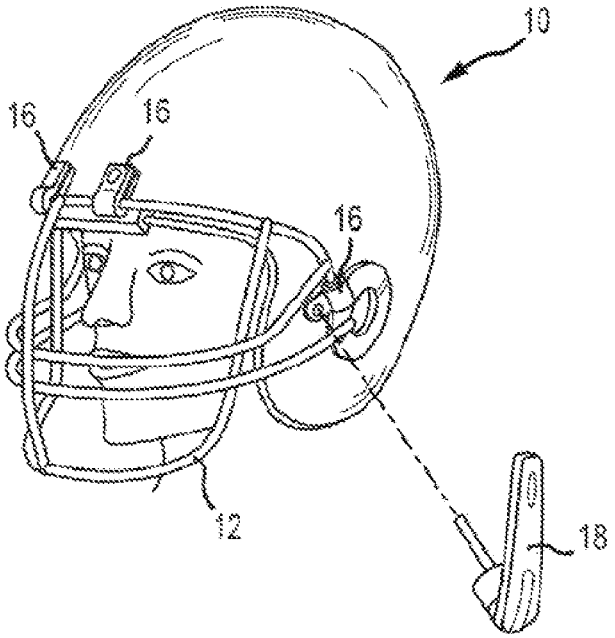
FIG. 8 is a perspective view of a player's helmet with a detailed magnified quick release assembly shown, as well as the positions of several rotating facemask securing mechanisms.
Figure 9:
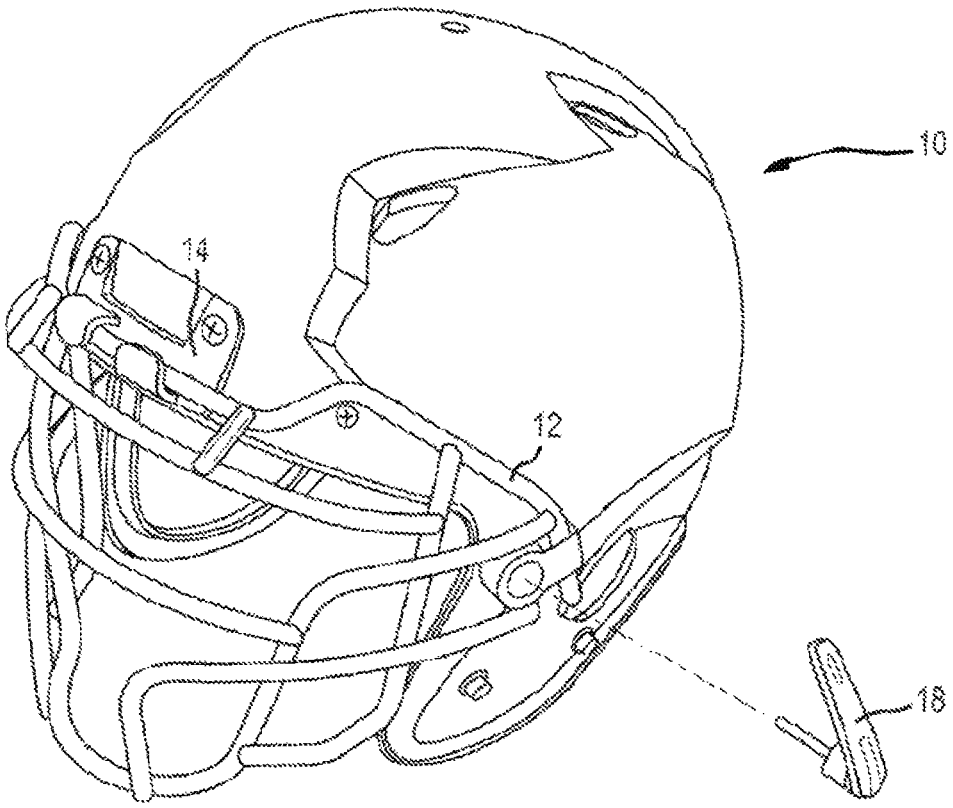
FIG. 9 is a perspective view of another embodiment where a different styled helmet and facemask design is shown associated with a quick release element in combination with a particular quick release forehead facemask connector.
Figure 10:
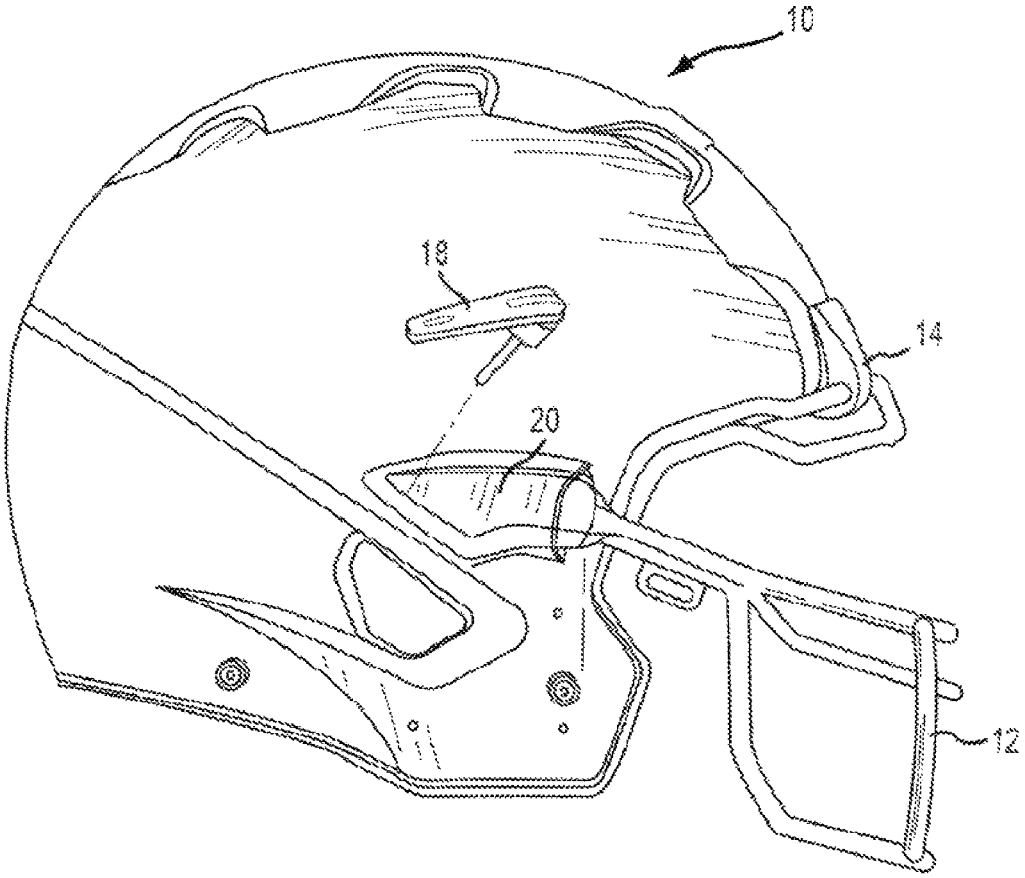
FIG. 10 is a side view of yet another helmet and facemask design where a shock absorbing assembly and a quick release assembly are shown.
Figure 11:
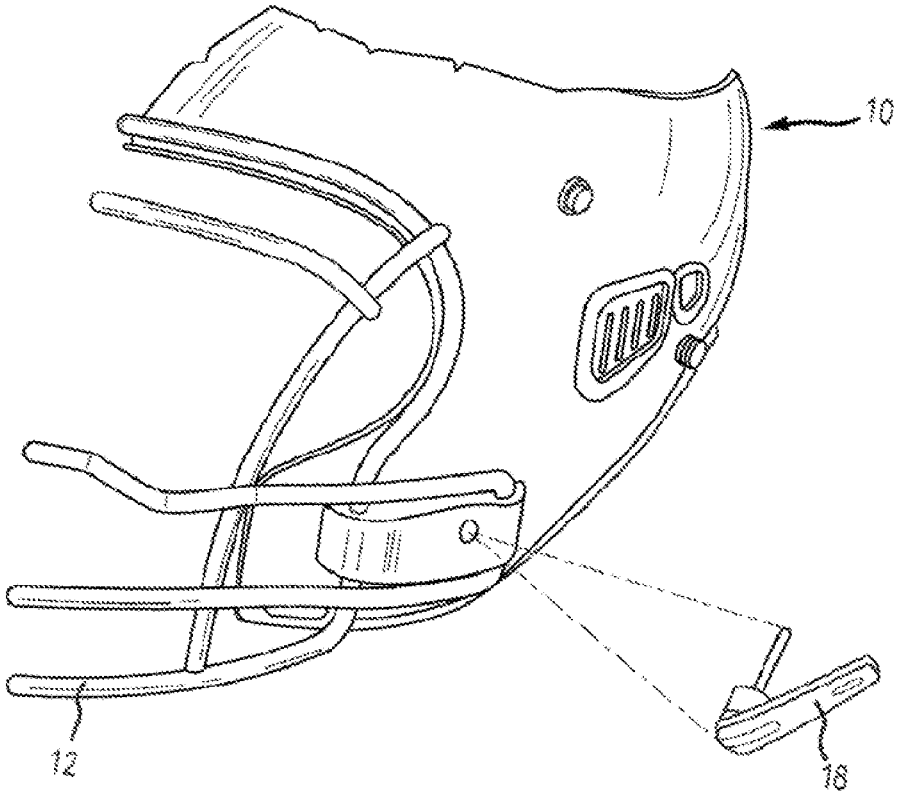
FIG. 11 is a partial side view of another helmet and facemask design, showing a quick release element to reversibly secure a facemask without direct connection to a facemask bar.
Figure 12:
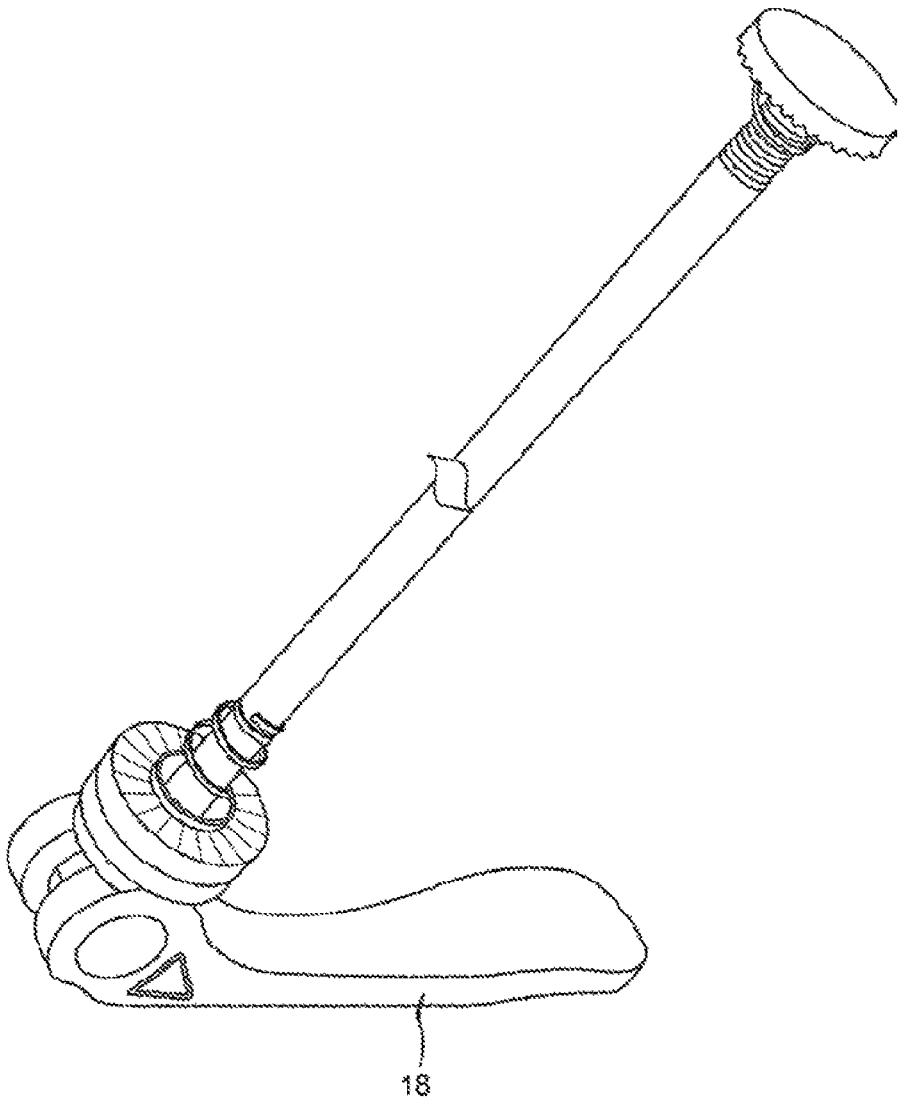
FIG. 12 is a perspective view of one embodiment of a quick release assembly without a helmet associated therewith.
Figure 13:
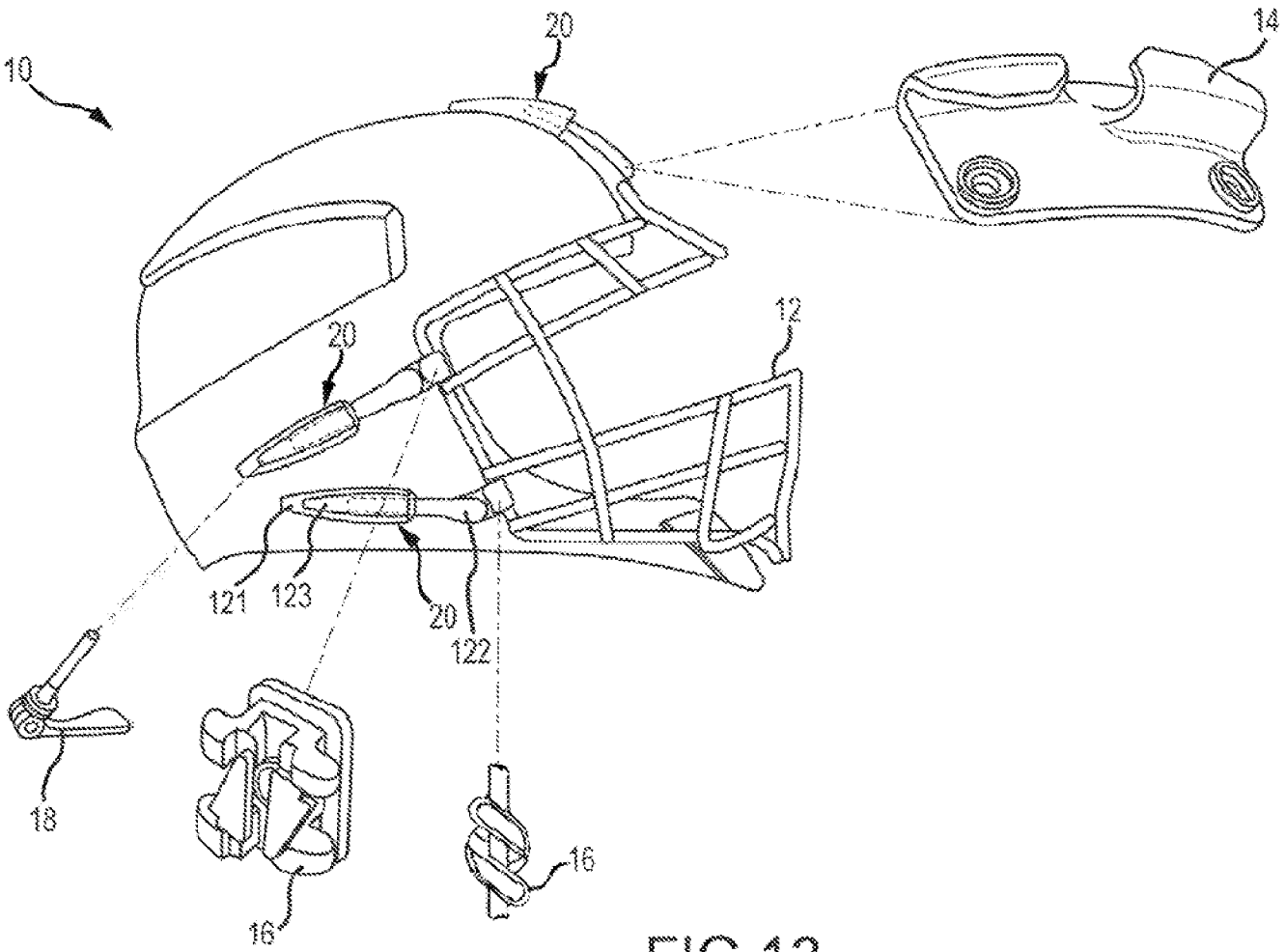
FIG. 13 is a side view of a helmet having shock absorbing assemblies, a quick release forehead element, a quick release assembly associated with a shock absorber assembly, and different styles of rotating facemask securing mechanisms.

In certain embodiments, one can select the materials employed to address desired impact forces encountered in a given sport activity. Thus, in addition to one or more springs of certain and predetermined strengths, plastic and rubber materials of particular construction, composition and amount can be used to provide the desired shock absorption abilities desired. In several embodiments, it is preferred not to employ springs as the shock absorbing elements 20, but to instead rely upon an elastomer to accomplish such function, as the reduction in weight, the avoidance of metal parts, etc. is sometimes desired. A combination of these reversibly compressible materials and elements can be employed to address impact and collision events such that damage to a person's head and brain are minimized.

Certain embodiments employ an integral surface of a helmet 10 that comprises an elastomeric cellular, foam material having an integral inner skin and an integral outer skin with physical characteristics which cause it to absorb energy from impact with another object, and rapidly and fully recover to absorb energy from the next impact, thereby reducing the potential for injury to the wearer of the helmet. In certain embodiments, padding of the helmet 10 comprises expanded polypropylene (EPP), which may comprise a lightweight amalgam of foamed poly propylene beads, molded into a semi-rigid structure. Impact energy may also be diffused by employing a closed cell foam material.

In certain embodiments, the face mask attachment is shock absorbing 20 and absorbs directional forces to collapse partially to reduce collision impact. Suitable shock absorption assemblies can employ a variety of shock absorption materials, including air, liquid, springs, telescoping constructs, etc. which can be used alone or in combination to function to cushion blows.

Certain embodiments include sensors to monitor translational movement of a player's head to assess whether certain impact collisions warrant injury and concussion concerns. While electronic sensors can be used, they tend to increase the cost and complexity of helmets, which is undesirable at least for little league and high school sports programs. Thus, in one embodiment, a color change agent is employed such that the facemask or helmet, particularly the interface of the two, includes such an agent to reveal whether that portion of the helmet has experienced severe impact, and thus, may be too weak to withstand additional impacts, and/or if a particular predetermined level of impact has occurred. This assists coaches in determining whether a player has been hit or impacted by a force of greater than a certain amount, thus aiding in determining whether the player should cease play at that moment. In other embodiments the securing mechanism that attaches the face mask to the helmet is comprised of PEEK and is fashioned in a structural manner such that it will stretch, bend or otherwise conform upon being hit.

In one embodiment, the frame of the face mask is provided with at least two telescoping sections, preferably positioned such that a frontal force to the face mask will cause the face mask telescoping portions to compress, such that the telescoping elements will slide within each other in a nesting arrangement. Preferably a cushioning element is employed that returns the face mask structure to its prior to impact position. Such an element can be, for example, rubber, plastic having desired rebound capabilities, foam, an air cylinder, a liquid filled reservoir (e.g. one that when impacted, can then squirt out an amount of liquid to permit the face mask structure to partially collapse upon an impact to the face mask.

When the connections between the face mask and helmet shell are rigid, stresses on the facemask 12 are transferred directly to the helmet shell 40 and can deform or crack the helmet shell 40 which again can result in an injury to the athlete wearing the helmet 10. Thus, in several embodiments a shock absorbing mount 20 is employed for the facemask 12 comprising a first attaching element 121 adapted for mounting on a helmet shell, a second attaching element 122 adapted for mounting on a helmet 10 a face mask 12 and having an extension portion movably engaged with the first attaching element 121 for plunger-like reciprocation relative thereto, and a shock absorbing resilient element 123 held between opposing surfaces of the first 121 and second 122 attaching elements.

To reduce the need to provide extensive disclosure in this application, but to provide adequate written description of the various devices and methods encompassed by the numerous embodiments of the present invention, various patents and patent publications are incorporated herein in their entireties by this reference. Several of such patents are directed to shock absorbing systems that can be employed; others to rotating securing assemblies, still others to quick release assemblies and further ones to various helmet, padding and facemask designs. With the guidance provided herein, one of skill in the art will appreciate the vast scope of different combinations that can be achieved and that are intended to be encompassed by the various embodiments of the present invention. These include: 2012/0297525 to Bain; U.S. Pat. No. 8,766,798 to Howard; CA 2288309 and 6292954 to Conchur; U.S. Pat. No. 8,756,719 to Veazie; 2014/0201890 to Kelly; 2014/0090155 to Johnston; 20130298316 to Jacob; U.S. Pat. No. 3,900,897 to Dunning; U.S. Pat. No. 4,370,759 to Zide; U.S. Pat. No. 5,708,988 to McGuine et al.; Shih, US Patent publication 2007/0151003; US patent publication 2008/0163410 to Udelhofen; U.S. Pat. No. 4,370,759 to Zide; 2014/0101829 to Witcher; U.S. Pat. No. 4,028,743 to Christensen; 2007/0151003 to Shih; U.S. Pat. No. 7,607,179 to Shih; U.S. Pat. No. 8,146,178 to Maddux, et al.; U.S. Pat. No. 8,079,610 to Winefordner; 2006/0127167 to Wu-Hong; 2013/0247285 to Bartsch; 2009/0031479 to Rush, III; 2004/0074283 to Withnall et al., U.S. Pat. No. 6,879,932 to Baudou et al.; 2013/0086733 to Szalkowski; 2014/0081601 to Zhang 2014/0133932 to Davies; U.S. Pat. No. 8,636,439 to Jaouen; 2015/0164174 to West; 2015/0173666 to Smith; U.S. Pat. No. 7,254,843 to Talluri; 2011/0203024 to Morgan; 2012/0017358 to Princip; 2014/0215693 to O'Gara; U.S. Pat. No. 9,032,558 to Leon; 2015/0101899 to Russo; U.S. Pat. No. 8,046,845 to Garcia; U.S. Pat. No. 6,131,196 to Vallion; 2011/0056004 to Landi; U.S. Pat. No. 8,938,818 to Ide; 2014/0208486 to Krueger; 2014/0068843 to Wegener; 2014/0196198 to Cohen; 2015/0107005 to Schneider; U.S. Pat. No. 8,844,066 to Whitcomb; and 2013/0025037 to Turner.

One embodiment is directed to a shock absorbing facemask attachment assembly for a helmet comprising a facemask, at least one compressive, shock absorbing assembly 20, such assembly having a longitudinal axis extending from the outer surface of the helmet 10, with at least one of the compressive elements comprising the shock absorbing assembly 20 maintained within a housing and in contact with the facemask, with the housing reversibly attachable to the helmet 10 by a quick release mechanism 16, such mechanism selected from the group consisting of i) a quick release skewer having a rotatable, pivoting lever, on one end of a shaft, and a threaded end on its other end 18, the threaded end being adapted to receive a helmet contacting nut, such that the nut is shaped so that it has a non-abrasive surface on an interior helmet-wearer side; and ii) a rotational retaining mechanism 16 having two opposing bar-like structures 164 rotatable to reversibly secure a facemask bar 13 associated with a facemask 12. Certain embodiments (see FIG. 22) also include a device for use in a system for monitoring protective headgear, preferably using a wireless device 120 employing a sensor module coupled to the protective headgear 10 that generates sensor data 17 in response to an impact to the protective headgear device 10 when the device interface is coupled to the monitoring device 110.

Certain embodiments also include a device for use in a system for monitoring protective headgear, preferably using a wireless device employing a sensor module coupled to the protective headgear that generates sensor data in response to an impact to the protective headgear device when the device interface is coupled to the monitoring device.

PEEK is a semicrystalline thermoplastic with excellent mechanical and chemical resistance properties that are retained to high temperatures. Because of its robustness, PEEK is used to fabricate items used in demanding applications, and displays certain shape memory behaviors when mechanically activated. In one embodiment, lighter high-tech materials, such as PEEK, are used to construct both helmets—as well as the face mask. In addition to material composition, in certain embodiments, design and overall shape and dimensions of the helmet/facemask assembly is important to ensure player protection form brain injury. Thus, the ratio of the face mask and helmet dimensions is important to consider when evaluating the overall shape and function of the football helmet in terms of how it can be designed to reduce the incidence of injury.

In certain preferred embodiments, the features included on a helmet 10 would include:

A shock absorbing system that comprises at least two shock absorption assemblies 20 on either side of a player's helmet 10 that permit substantially horizontal movement of the facemask 12 when a significant force is apple thereto;

A face mask 12 constructed primarily of a lightweight plastic material, preferably comprising PEEK, that has certain memory shape characteristics and that can withstand the rigors involved in collision sports, such as football, hockey, lacrosse, etc.

A quick release system that employs at least one, and preferably at least two reversibly detachable elements 16 that secure a facemask to a helmet 10. The quick release system preferably comprises quick release mechanisms 16 similar to those employed in bicycle components, such as those that are used to adjust seat heights and to secure a bike wheel to the frame. In contrast to other system that purport to be "quick release", the present system is devoid of the need for a separate tool, such as a screwdriver, to enable operation of a quick release operation. Indeed, the confusion as to what tool may be required and who has sufficient training to use a particular tool for the myriad of different helmets used by players, often results in the use of cutting tools to attempt to sever the tough plastic facemask connectors used on helmets to secure facemasks. This cutting procedure not only has shown to take almost three times as long as a screwdriver removal process, but also is believed to cause more trauma to the injured player due to movements of the head and neck in the cutting process, as well as delaying desired medical activities to proceed. While certain preferred quick release mechanisms are set forth herein, one of skill in the art will appreciate the many various ways to make and use manually twist-and-turn mechanisms that have a first locking, secure position (where the facemask is held in place); and a second facemask removal position where the facemask is free to be detached from the helmet 10. One such rotational retaining mechanism 16 is found, for example, in Dupray, U.S. Pat. No. 8,678,818, where two opposing bar-like structures 164 are rotated to reversibly secure a straight length of the facemask portion 13. In the context of a facemask being secured to a helmet, such a reversibly locking, rotating configuration 16 can be employed to reversibly secure the facemask 12 to the helmet 10 in one or more connection points, preferably at least two points, in other configurations in at least three points and in others, four or more points. The increase in number of rotating connection points 16 serves to ensure that one malfunctioning or unintentionally rotated unit 16 will not cause the facemask 12 to detach. But the inclusion of additional hardware of this sort does increase the cost, complexity and weight of the helmet 10.

A facemask configuration that limits the lever-like attributes of the facemask in relation to the helmet 10, such that when damaging facemask collisions occur, there is less of a likelihood of damage to a player due to the reduced length of the face mask 12 as measured from its exterior distance away from the face.

The combined use of these aspects presents a helmet 10 that is lightweight, force-absorbing head protective device that is less prone to causing injuries to a player due to a reduced side profile (e.g. less leverage due to a confined side aspect), and thus presents a helmet having superior safety characteristics as compared to any existing helmet on the market. In terms of addressing contact forces encountered in contact sports, such as football, not only is the claimed helmet 10 designed so as to reduce the chances that injuries will occur, but when injuries do happen, the quick release features of the helmet design permit far more rapid medical attention to a player.

With respect to the quick release features described herein, the release lever can be accessed by either the player themselves, or an attendant coach, so as to have the facemask 12 completely removed within 30 seconds of first attempting such a removal operation. In comparison, the best average times for removal of facemasks using Riddell's so-called "quick release" system is 33 seconds. Preferably, using the present invention quick release design, the facemask 12 can be entirely removed from the helmet 10 in less than 25 seconds, even more preferably in less than 20 seconds, more preferably still in less than about 15 seconds, and most preferably in less than about 10 seconds. This reduction in time to remove a helmet 10—especially without the necessity of any separate tool, such as a screwdriver, etc. is critically important when it comes to administering care to an injured player and in assessing how best to address his/her injuries.

The disclosure herein describes preferred embodiments of the invention claimed hereinbelow; however, other changes and modifications to the claimed invention may be made which are still contemplated within the spirit and scope of the present disclosure.

The foregoing disclosure has been provided for purposes of illustration and description. This disclosure is not intended to limit the invention claimed herein below, and various embodiments thereof. Variations, embodiments and modifications will be apparent to those skilled in the art and are intended to be within the scope of the following claims.

Particular embodiments employ a quick release facemask bracket device 16 that is similar in many respects to devices employed in the bicycle field, often referred to as a quick release skewer. In the context of helmets, however, the skewer portion is substantially shortened so that it spans the distance between the interior and the exterior of a player's helmet 10. The shorter quick release skewer 18 is run through a pre-made aperture in the helmet 10 in a position where most conventional helmets also have an aperture for the connection point between the helmet 10 and the facemask on either side of the helmet 10. The exterior of the quick release skewer 18 has a pivotable lever that pivots about a cammed surface such that closure of such member to be in a position substantially flush with the helmet 10 exterior, effectively locks the quick release skewer 18 in a secure position, with the lever not only being pivotable, but rotatable around a threaded portion of the quick release skewer 18 such that the threaded distance between each end of the quick release skewer 18 and the pivoting lever is shortened, thus tightening the unit to the helmet 10. Pivoting of the pivotable lever of the quick release skewer 18 after desired rotations are made is achieved via moving the lever from a position where the lever is substantially perpendicular to the surface of the helmet 10 side, to a position where the lever is pivoted flat against the side of the helmet 10. In certain embodiments, the helmet 10 has a slight cavity into which the pivotable lever of the quick release skewer 18 can reside, thus lessening the chances that such lever would be inadvertently pivoted outward due to collision with a third object.

A significant advantage afforded due to use of the above-described quick release pivotable lever of the quick release skewer 18 is that no additional tools are required to reversibly engage and disengage a player's facemask 12 from the helmet 10. As one of the major concerns at the present time is that necessary tools are available by the coach, emergency responsive teams, etc. when a player suffers an injury due to a helmet collision, the avoidance of a requirement for any such tools represents a considerable advance in the art. To remove the face mask 12 of a downed, injured player in a time period that compares well with present day removal schemes—which require some tool to perform such an operation (e.g. a screw driver, a cutting tool, a pin that is specially adapted for insertion into a quick-release holed structure—such as in the Riddell QR helmet)—one need only to flip the pivotable lever of the quick release skewer 18 from its flush-to-the-helmet position, outward so that the lever can be manipulated. In some embodiments, the rotation of the lever of the quick release skewer 18 about the axis of the screw structure associated therewith is sufficient to cause the loosening of the connection between the helmet 10 and the facemask 12, with particular embodiments having the unthreading of the lever from the quick release skewer 18 proceed until the lever and attached screw structure 15 is disassociated with the nut element 17 residing on the inside of the helmet 10. Such an operation of flipping the lever, rotation of the lever several times and disassociation of the connection point that connects the helmet 10 and the facemask 12 can preferably be achieved in literally less than 5 seconds, but even to the novice caregiver of such player, can be performed in less than 30 seconds (which is faster than the average fastest detachment time achieved using prior art so-called "quick release" devices. One can certainly perform the lever release and rotation operation using both hands such that both sides of a player's helmet 10 can be addressed simultaneously and without the need for any separate tool to achieve disengagement.

Incorporated herein by reference are the multitude of quick release mechanisms that have been employed in the bicycle field to achieve a similar goal of securing fastening various components of a bicycle together, such as adjustment mechanisms for the seat height, the connection of a wheel to the forks, etc. One of skill in the art, with the guidance provided by this disclosure, can readily adopt such structures to serve the purposes of reversibly and securely connecting the portions of a facemask 12 to a player's helmet 10 using such quick release bracket devices 16. For purposes of illustration, the present inventors incorporate by reference U.S. Pat. Publication No. 2013-0334871 to Chang directed to a quick release lever for this purpose. A quick-release skewer and a quick release seat post clamp modified to be used for a helmet 10 connector, comprises a shaft having threaded ends, a nut on one end, and a camming mechanism on the other end. Still other embodiments include the use of a second lever having a cam surface and an opening on one end and a lever portion on an opposite end, wherein the opening of the second lever engages a second portion of the pin.

In certain embodiments employing the described quick release lever mechanism, it may be desirable to further include a means for retaining the lever in a position that is close to the helmet exterior, such that the lever does not inadvertently pop open and away from the helmet during contact of the helmet with another object, such as an opponent's helmet. Various securement mechanisms can be employed for this purpose, including but not limited to magnetic attraction between the lever and another metallic or magnetic component fixed to the helmet region that is adjacent to the lever when in its closed position. A small elastic member, such a rubber or plastic loop, can also be used, which is fixed to the helmet and that is adapted to encircle the end point of the lever of the quick release skewer to hold it in a closed position, nearly flush with the helmet. The forces required to loop the lever in the elastic member is minimal, as it must merely pull the lever or hold the lever in the closed position, and thus, collisions will only cause the lever to possibly attempt to flip upwards, only to encounter the countervailing elastic forces that retain the lever in the flush helmet position.

Other embodiments of the invention relate to the combination of a quick release bracket feature 16 on at least one, preferably two and most preferably three or more facemask connection points on the helmet 10, together with a shock absorption assembly 20. For example, a shock absorbing assembly 20 similar to that described by U.S. Patent publication No. 20080163410 to Udelhofen; (European Pat. No. EP 2223619); and U.S. Pat. No. 7,607,179 to Shih, all of which are hereby incorporated herein by this reference, is used on each side of a helmet 10 to reduce the impact of collisions. Such assemblies 20 are operably associated with a quick release bracket assembly 16 such that a player can mount his/her facemask 12 to their helmet 10 in a quick fashion and enjoy the benefits of having a shock absorbing facemask assembly 20, in addition to having the ability of having such a facemask 12 removed and detached via the quick release bracket features 16 described herein. The prior art is devoid of such a combination of features, with shock absorbing structures described as being securely connected to the helmet 10 in a fashion such that traditional removal techniques are required, e.g. screws what required a screwdriver; cutting tools, etc., to detach such facemasks from the helmet. One of skill in the art, however, will appreciate that various other shock absorbing structures and assemblies can be used together with the multitude of quick release features that exist, such that a player is afforded, for the first time, a helmet 10 that not only absorbs impacts (e.g. through a variety of shock absorbing structures 20 and components) that would otherwise be communicated and experienced by the player's brain, and also a facemask connection system that provides for the removal of the facemask in a time shorter than the best currently available times for facemask removal, i.e. an average of 33 seconds or more.

In a particular embodiment, the forehead region of the facemask connection 14 to the helmet 10 comprises a facemask retaining structure 20 that does not involve any moving parts, but rather, relies upon the simple manipulation of the facemask (e.g. once released from its connection points on either side of the helmet 10) to disengage the facemask entirely from the helmet 10. Such a device is depicted and described in U.S. Pat. No. 8,146,178 to Maddux, which is hereby incorporated by this reference. One will appreciate that in other embodiments, a quick release bracket assembly 16 as described herein can be used for the forehead helmet connection 14 for particular facemasks 12, as well as in combination with a shock absorbing structure 20 affiliated therewith.

In other embodiments of a quick release assembly, a rotating assembly 162 that has a first open position (e.g. for receiving a facemask bar 13 structure in a slot 160 of the assembly) and a closed position (e.g. whereby the rotation of the quick release assembly mechanism 16 entraps the facemask bar 13 within the assembly, effectively providing a rotating top via which the facemask 12 is held within the slot 160. Incorporated herein by this reference is U.S. Pat. No. 8,678,818 to Dupray, et al. which, while directed to an orthodontic self-ligating bracket, has structural and functional components that the present inventors appreciated, for the first time, could be employed to achieve the quick release functions, desired in the disparate area of sports helmets, such as football helmets 10. In certain embodiments, it is possible to mix-and-match various quick release assemblies 16 as described herein so as to achieve desired structural and functional designs. Thus, for example, a quick release assembly 16 similar to the structure described by Dupray et al., may be employed for the forehead region 14 of a helmet 10, while the quick release assemblies 16 that are more similar to bicycle quick release skewers 18 may be employed for the side connection points of a facemask 12 to helmet 10. It is also possible to employ the static facemask device as described in Maddux, U.S. Pat. No. 8,146,178, on the side of a helmet 10, rather than as envisioned by Maddux as solely for use on the forehead 14 of a helmet 10, such that a player may simply connect his facemask 12 first to one side of the helmet via the Maduxx assembly, rotate the facemask 12 so that it is in engaging position with either the opposite side of the helmet 10—which may employ one or more of the quick release assemblies 16 as described herein, or alternatively, another of the quick release assemblies 16 may be provided in the forehead region 14 of the helmet 10. As there is a desire for lighter weight helmets 10, the ability to provide for at least quick release of facemask functions while maintaining the weight and complexity of structures for such purpose, is an important objective. Thus, as the connection device described in U.S. Pat. No. 8,146,178 to Maddux has no moving parts and affords detachment of a facemask 12 once the opposite side of the helmet 10 is freed from engagement (e.g. via the sight twisting of the facemask 12 out of engagement with the upward and downward turned engagement sections of the Maddux device, one preferred embodiment of the present invention, especially when just two (rather than three or more) connections points between the helmet 10 and the facemask 12 are involved, is to provide just one quick release skewer 18 on one side of the helmet 10, thus reducing weight, providing for even faster detachments of a helmet 10, and also avoiding possible inadvertent release of the quick release assemblies 16 during impact of the helmet 10 with a third object. One objective in removing a facemask 12 is to create as little or no movement of the player's head and to finish the facemask removal procedure in as short a time as possible. This is made possible by employing one or more of the features as described herein.

In other embodiments, more than one of the rotating enclosure assemblies 16 (e.g. larger in size than the Dupray, et. al constructions and sized to accept a face mask bar 12 portion so that the two cover elements that are rotated between an open and closed configuration, act to entrap the facemask bar portion 13, locking the facemask bar portions 13 in engagement, thus reducing the prospect that unintentional disengagement would occur due to the redundancy of the rotating entrapment facemask bracket assembles 16. In a preferred embodiment, at least two of such facemask bracket assemblies 16 are employed, and in still other embodiments, three or more.

It will be understood that the quick release assemblies 16, including but not limited to the quick release skewer 18 and the large version of the orthodontic self-ligating devices described herein, can be and preferably are constructed of a relatively light weight plastic so that the weight of the helmet 10 is kept to a minimum. Of course, such elements can be constructed of metal materials to the extent such weight concerns are not paramount.

In a particular embodiment, where a facemask 12 has three connection points to a helmet 10, the forehead connection point 14 comprises a bracket that has no moveable parts, such as the Maddux device described herein. The opposing sides of the helmet 10 have a quick release assembly 16 selected from the group consisting of a rotatable element 162 that accepts the facemask bar portion 13 such that once the facemask bar portion 13 is fitted into the slot 160, the slot cover members 164 are rotated into a closed position, whereby the facemask bar 13 is entrapped by the slot cover members 164, thus restraining the facemask bar portion 13 to the helmet 10. The slot cover members 164 can be comprised of steel or hardened plastic, but are sufficiently robust so that the facemask 12 is held firmly in place to the helmet 10, and yet the facemask 12 can be readily removed from the helmet 10 in the event of an injury to the player wearing such helmet/facemask.

In other embodiments, PEEK is employed as the material that comprises a substantial majority of at least the facemask portion of a helmet construction. PEEK is well known in the medical device industry as a reliable, sturdy, durable material that is biocompatible and resilient, such that many orthopedic implants are constructed of PEEK due to its resilience and ability to absorb shocks without adversely affecting its integrity. Thus, while any suitable plastic having the desired strength, durability and impact resistance may be employed in various embodiments of the present invention, PEEK is believed to be particularly preferred due to its long history of excellent physical and functional capabilities.

Still other embodiments employ a magnetic clamping system 19 to reversibly secure a facemask to a helmet 10. Such connection systems have been employed in other fields, for example, in anti-theft devices, but have not previously been used to secure facemasks 12 to helmets 10. Magnetic detach mechanisms and assemblies hereinafter referred to as magnetic detachers 21 can thus be employed as they are readily available and relatively inexpensive as they are ubiquitous in many retail establishments and are used to attach to clothing. The strong magnetic field from the magnetic detachers 21, often caused by a rare earth permanent magnet that is used to attract a spring piece in a magnetic locker, can reach to about 4000-6000 Gauss. One of skill in the art will appreciate the various ways in which a magnetic securement assembly 19 can be positioned on a helmet 10 so as to enable a detach mechanism to be used to quickly achieve detachment of the magnetic securement/connection system so as to release a facemask 12 from a helmet 10.

Figure 14:
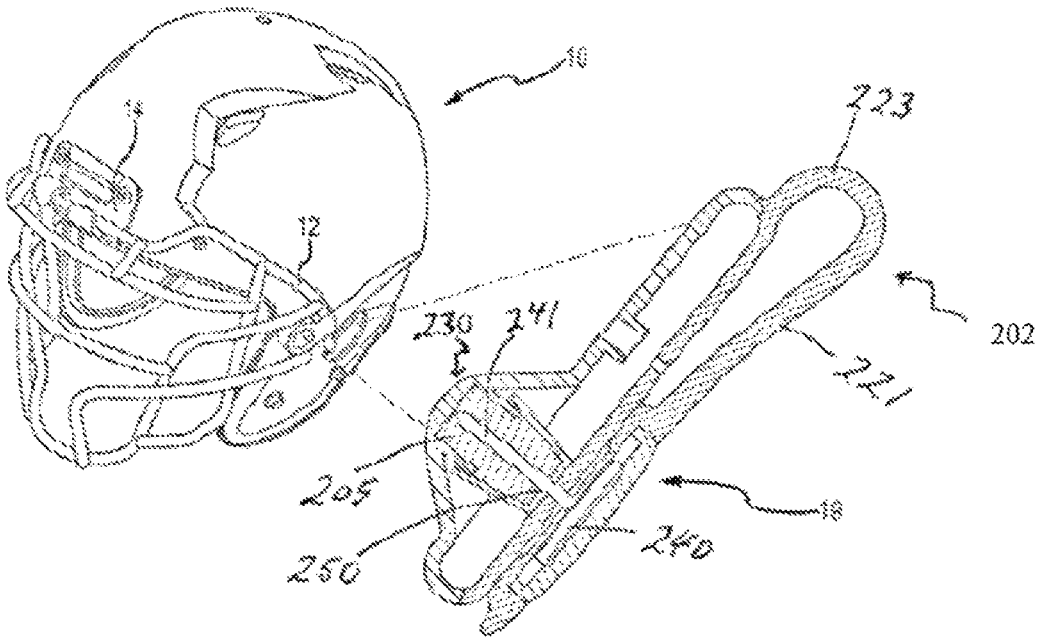
FIG. 14 is a perspective view of one embodiment of a helmet and facemask construction with an enlarged detail of a magnetic securement assembly having a loop feature to encircle a facemask portion.
Figure 15:
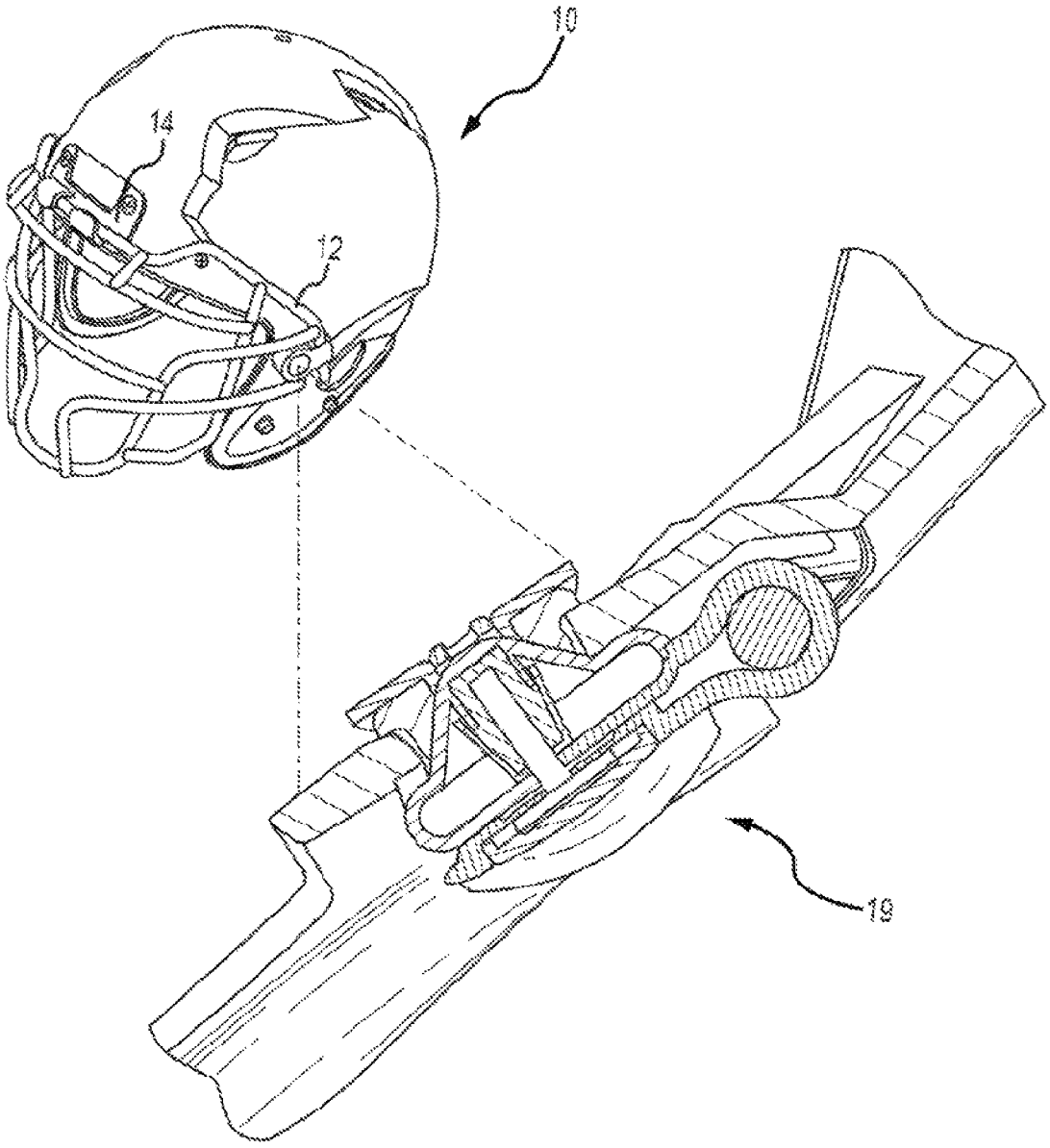
FIG. 15 is another view of a similar magnetic securement assembly as shown in FIG. 14.
Figure 16:
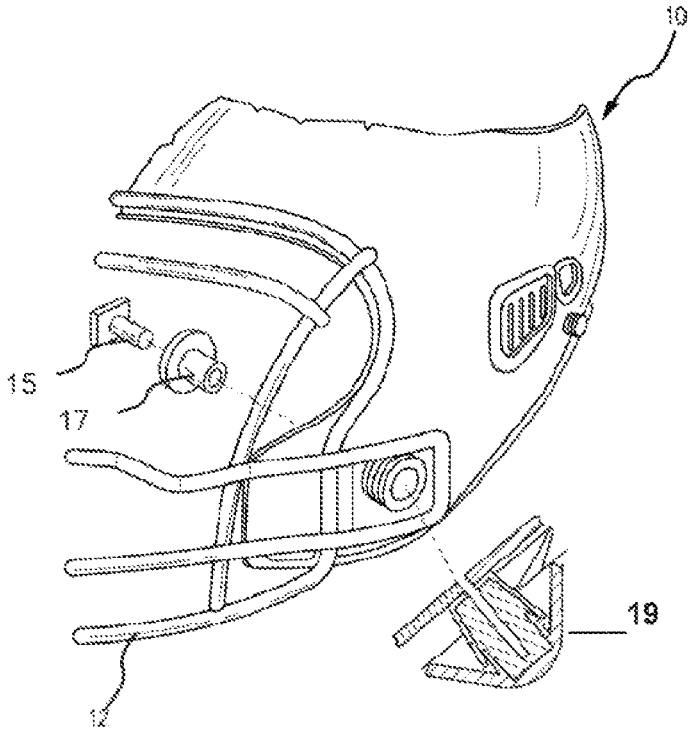
FIG. 16 is an explosive view of a magnetic securement assembly that reverses the orientation of the magnetic assembly as shown in FIG. 14.
Figure 17:
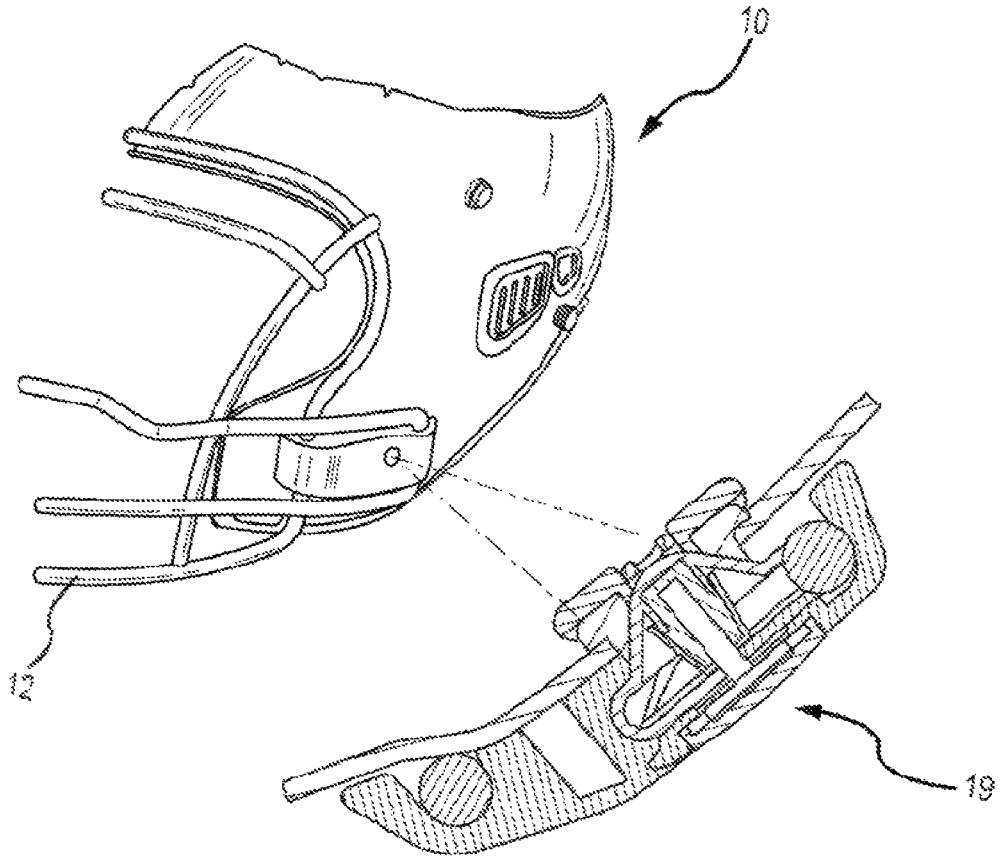
FIG. 17 is a perspective view of one embodiment of a helmet and facemask construction with an enlarged detail of a magnetic securement assembly where two separate portions of a facemask are secured via one magnetic construct feature.
Figure 18:
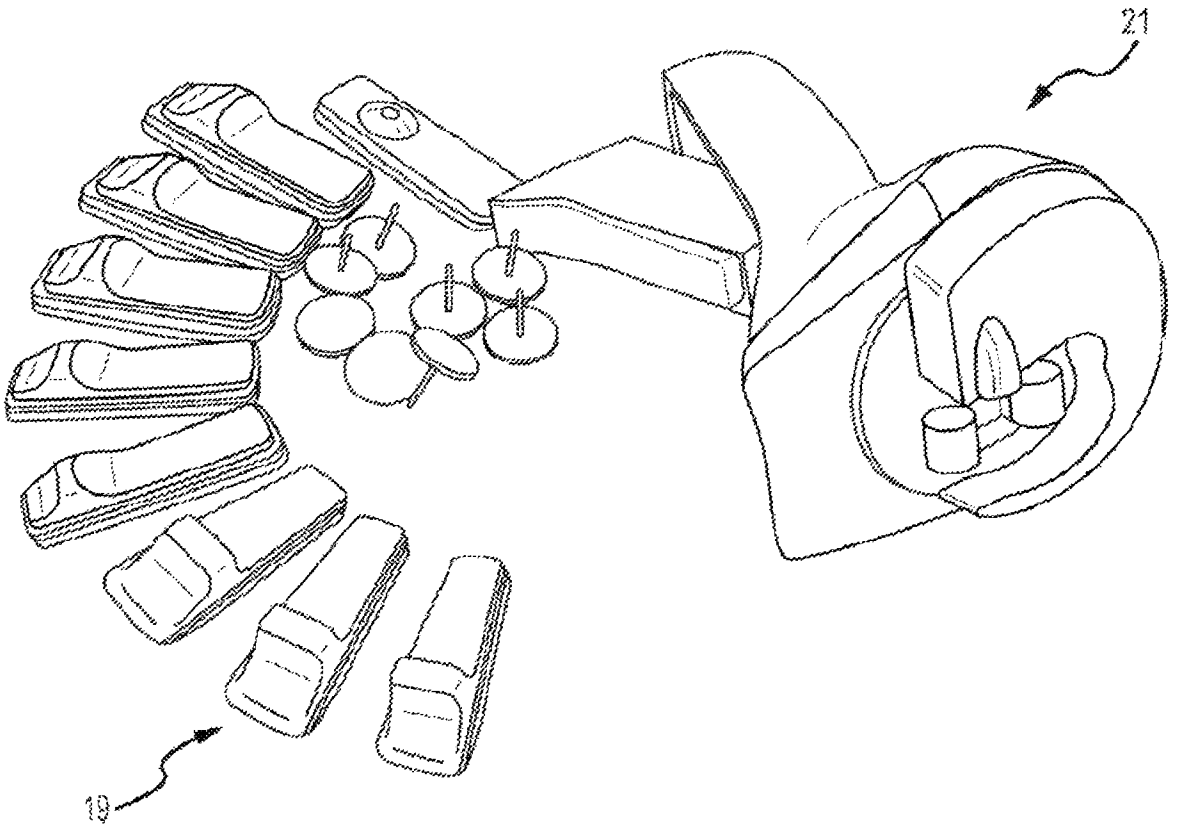
FIG. 18 is an illustration of various magnetic securement mechanisms that can be associated with a helmet/facemask, as well as a partial view of a magnetic removal tool that can be employed to achieve a quick (reversible) release operation of a facemask and a helmet.
Figure 19:
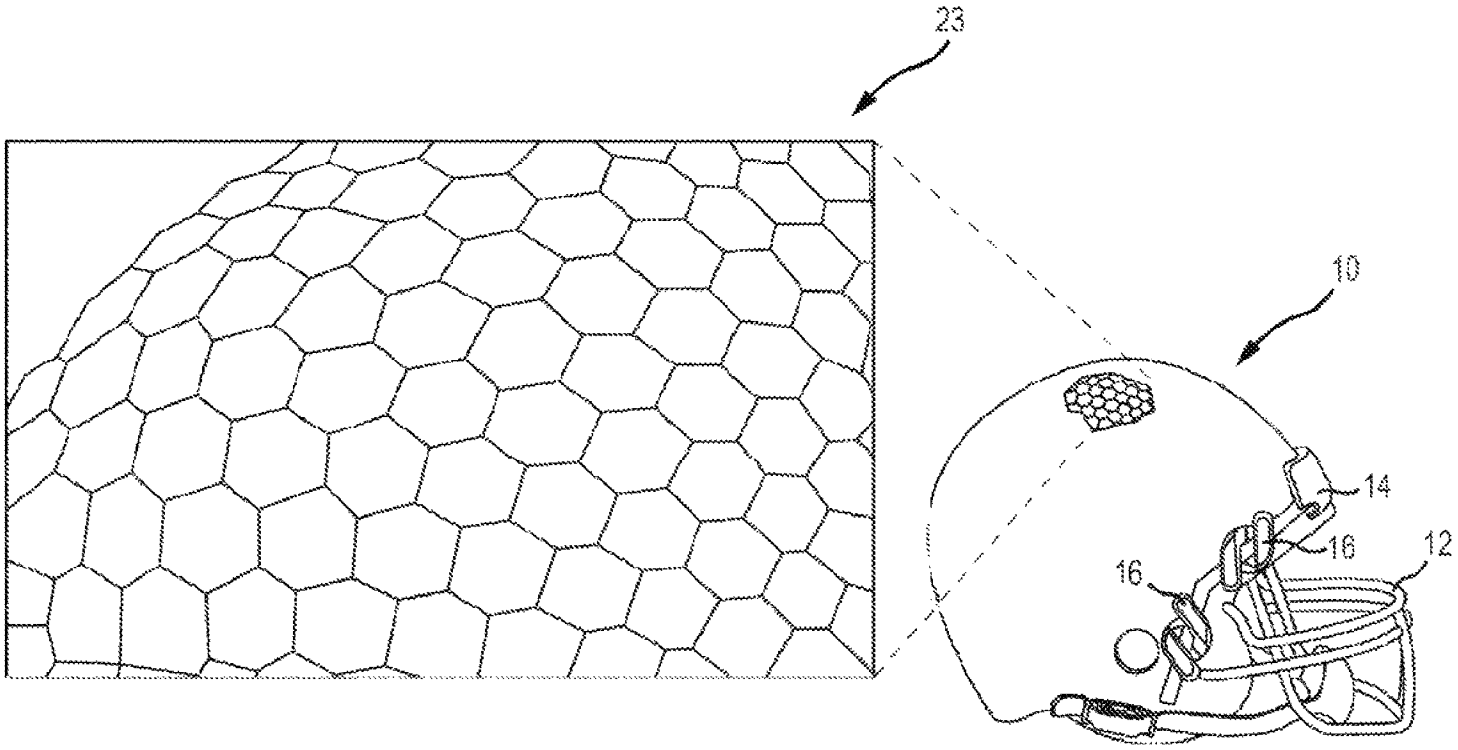
FIG. 19 is a perspective view of a helmet/facemask with an enlarged detail of an armadillo-type structure of at least one layer of the helmet.
Figure 20:
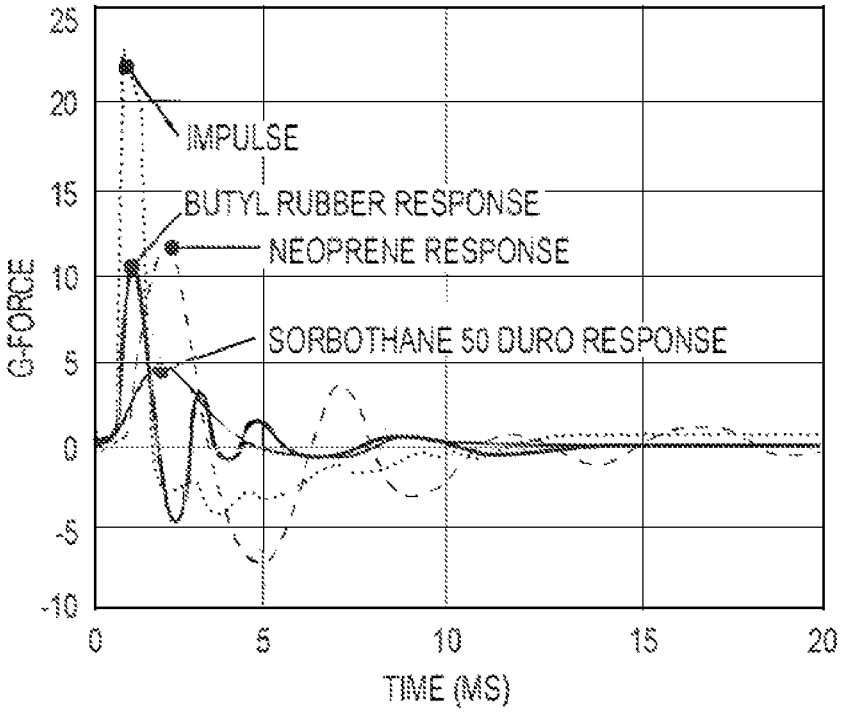
FIG. 20 is a graph that illustrates the time delay effect of impulse/shock responses of selected materials, including the Sorbothane material employed in various preferred embodiments.

As illustrated on the sectional view in FIG. 14, the attachment part includes a body 230 in which is placed a locking system 205 adapted to retain the stem post 241. The locking system 205, the technical details of which are not described here because they are of a type known in itself, includes a receiving recess 250 in a shape that is capable of receiving the stem 241. The body 230 is attached to the fastening part 202. The stem post 241 is connected to a post head 240. The body 230 is molded around the locking system 205 and the fastening part 202 includes the tab 221 which could be made integral with the body 230 at its base 223. The entry of the recess 250 of the body 230, is designed to be crossed by the stem post 241 for inserting it in the recess 250.

In various embodiments, an attaching mechanism for the facemask to a helmet is releasable by applying a magnetic detacher 21 to magnetically pull up a metallic spring and release a locking pin. In certain embodiments, applying a magnetic force pulls a metallic spring away from a first position to detach a pin from a second locking position. Preferably, the pin used for attaching and locking has a smooth surface without a groove (although grooved pins, cylinders, posts, etc. may be employed)—and preferably the post used is thicker (e.g. has a greater diameter) than the posts employed in retail stores, where pins having relatively sharp points are employed. The strength of attachment can be conveniently adjusted by simply changing to a spring having a different pressing force. In a preferred embodiment, the attaching-detaching mechanism includes a locking mechanism for locking to an attachment pin or cylinder. The locking mechanism is pressed by a pressing spring for tightening the locking mechanism to lock the attachment pin. The pressing spring is releasable by a magnetic pulling force to release the locking mechanism to detach the attachment pin from the locking mechanism. Several of the patents incorporated herein by reference in their entireties are directed to the myriad of ways one can construct suitable magnetic locking systems and assemblies 19 that can be used in various embodiments with a magnetic detacher 21 to achieve desired reversibly secured facemasks to a helmet.

In certain embodiments, the facemask (or device securing the facemask to the helmet) is removed by means of a magnetic detacher 21. In one embodiment, a locking system is applied which comprises a retaining part made of magnetic material that is adapted to be moved and associated with a spring. By positioning the device bearing the locking system on the magnet, the creation of a magnetic field around the magnetic retaining part that is sensitive to the field leads to the retaining part being attracted; the movement of the part releases the stem of the post/cylinder, which is then pushed back elastically by the spring. The two parts, including the locking system and the post, can then be separated from each other. The spring makes it possible to open the fastening element very speedily out of its recess, giving it a guaranteed spring effect for ejection, thus making the handling of the device speedier. A suitable detacher 21, such as those available from Unitoptek (under the Sensormatic trade name) removes the pin/post from a connector, thus releasing the facemask connection assembly. There preferably is no need for any batteries and/or an electrical power source, but certain embodiments may employ powered handheld systems, preferably operated by batteries, such as rechargeable batteries, especially those that can be powered by a hand or manual wind up system to generate power for the hand-held device. To comply with written description and enablement requirements, incorporated by reference in their entireties are the following: U.S. Pat. No. 8,125,338 to Li; U.S. Pat. No. 7,073,236 to Xue, et. al.; U.S. Pat. Nos. 8,528,118 and 7,146,652 to Ide (assigned to Riddell); U.S. Pat. No. 8,573,011 to Thoonsen; U.S. Pat. No. 4,603,453 to Yokoyama; U.S. Pat. No. 8,242,910 to Skjellerup; U.S. Pat. No. 6,700,489 to Easter; U.S. Pat. Nos. 5,729,200 and 6,181,245; 8,746,580 to Li; U.S. Patent Publication Nos. 2014/0223646 and 2014/0173810 to Suddaby; 2011/0010829 to Norman; 2014/0223646, 2014/0223644 to Bologna, 2017/0303622 to Stone; 2017/0196295 to Glover; 2017/0196294 to Fischer; 2017/0196292 to Reinhall; 2017/0196291 to Glover; 2016/0255900 to Browd and 20160278470 to Posner et al.

As explained in greater detail herein, the impact attenuation systems and assemblies described herein may comprise at least one impact attenuation member. The impact attenuation member is purposely engineered to change how the front portion responds to an impact force applied substantially normal to the front portion as compared to how other portions of the shell respond to that impact force. In one version of the helmet 10, the impact attenuation member is configured to resemble, either structurally and/or functionally, a three ringed Brazilian armadillo shell, with the important caveat that the material between 50 the hard portions 40, 30 (further described below) are comprised of a highly-damped, visco-elastic, polymeric solid, such as a polyether based polyurethane. In preferred embodiments, Sorbothane® is employed because it "flows" like a liquid under load and is a thermoset, polyether based polyurethane that combines high energy absorption with near faultless memory. Sorbothane® is considered a "super soft" polyurethane that can simultaneously absorb shock and vibration energy which makes it preferable to one dimensional materials like rubber and other polyurethanes.

In preferred embodiments, the helmet 10 has at least one layer that includes an array of polygonal structures 23, most preferably including hexagonal patterns that are prevalent in nature due to their efficiency and strength. In a hexagonal construct, each line is as short as it can possibly be if a large area is to be filled with the fewest number of hexagons. Thus, honeycombs are efficiently constructed to minimize the use of wax and gain lots of strength under compression. Groups of hexagons can form a regular tessellate with 3 hexagons around every vertex, providing superior structural strength, such as seen in the crystalline structure of graphene, e.g. a hexagonal grid. In one preferred embodiment of the present invention, a helmet 10 employs a myriad of hexagonal structures 23 that reassemble—both structurally and functionally—the shell of an armadillo.

Thus, one embodiment is inspired by the three-banded armadillo, which became the mascot of the 2020 FIFA World Cup hosted by Brazil. The armor defense system of the Brazilian three-banded armadillo makes it safe from the majority of predators as it is composed of ossified dermal scutes covered by nonoverlapping, keratinized epidermal scales, which are connected by flexible bands of skin. Armadillo shells are tough but relatively flexible. In certain embodiments, a helmet 10 incorporates such structural and functional features of an armadillo shell and is composed of a tough material such as a plastic (polycarbonate) for an array of polygonal (preferably hexagonal-shaped) sections 23, while using a softer material between the hexagons 23 (e.g. a highly-damped, visco-elastic, polymeric solid, such as a polyether based polyurethane) so that the helmet 10 is flexible and durable. The material between the hexagons may be, for example, an elastomeric material. Other embodiments can be comprised of any suitable material that provides the desirable characteristics and response to impact. For example, the padding layer of the helmet 10 can comprise one or more of the following materials: thermoplastic polyurethane (available, for example, from Skydex Technologies), military-grade materials, impact absorbing silicone, D30® impact absorbing material, impact gel, wovens, non-wovens, cotton, elastomers, IMPAXX® energy-absorbing foam (available from Dow Automotive), DEFLEXION shock absorbing material (available from Dow Corning), Styrofoam, polymer gels, general shock absorbing elastomers, visco-elastic polymers, PORON® XRD impact protection (available from Rogers Corporation), Neoprene (available from DuPont), Ethyl Vinyl Acetate, impact-dispersing gels, foams, rubbers, and so forth. The padding layer can further be breathable and/or generally porous to provide ventilation. In some embodiments, the padding layer is a mesh material that aids in the breathability.

Figure 21:
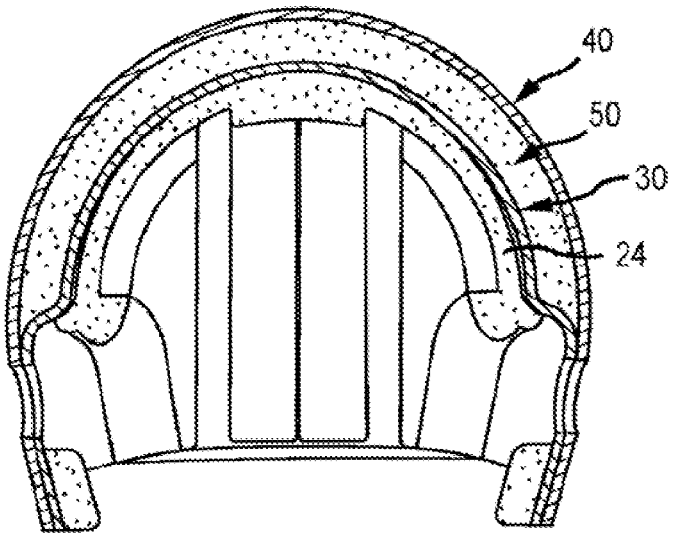
FIG. 21 shows an inner shell and an outer shell, with one or more layers of internal padding or pads connected to the inner shell to provide impact absorption.

FIG. 21 shows an inner shell 30 and an outer shell 40, with one or more layers of internal padding or pads 24 connected to the inner shell 30 to provide impact absorption. An external energy absorbing layer 50 is positioned between at least a portion of the outer surface of the inner shell 30 and the outer shell 40. The helmet is designed to dampen the energy of a jarring impact to the outer shell assembly 40 before reaching the hard inner shell 30. Such an arrangement directs and dampens all of the impact energy into the external padding system 50 outside of the inner shell 30.

In certain embodiments, a rigid inner shell defines a space where one or more compartmentalized sealed elastomer energy absorbing cells are located so that the helmet comprises a flexible outer shell and an inner shell, with the inner shell being more rigid than the outer shell, and with an intervening space containing one or more diffusion cells. In some embodiments, the dual shell isolates a primary energy absorbing mechanism (diffusion cell(s)) between the flexible outer shell 40 and a more rigid inner shell 30.

Figure 22:
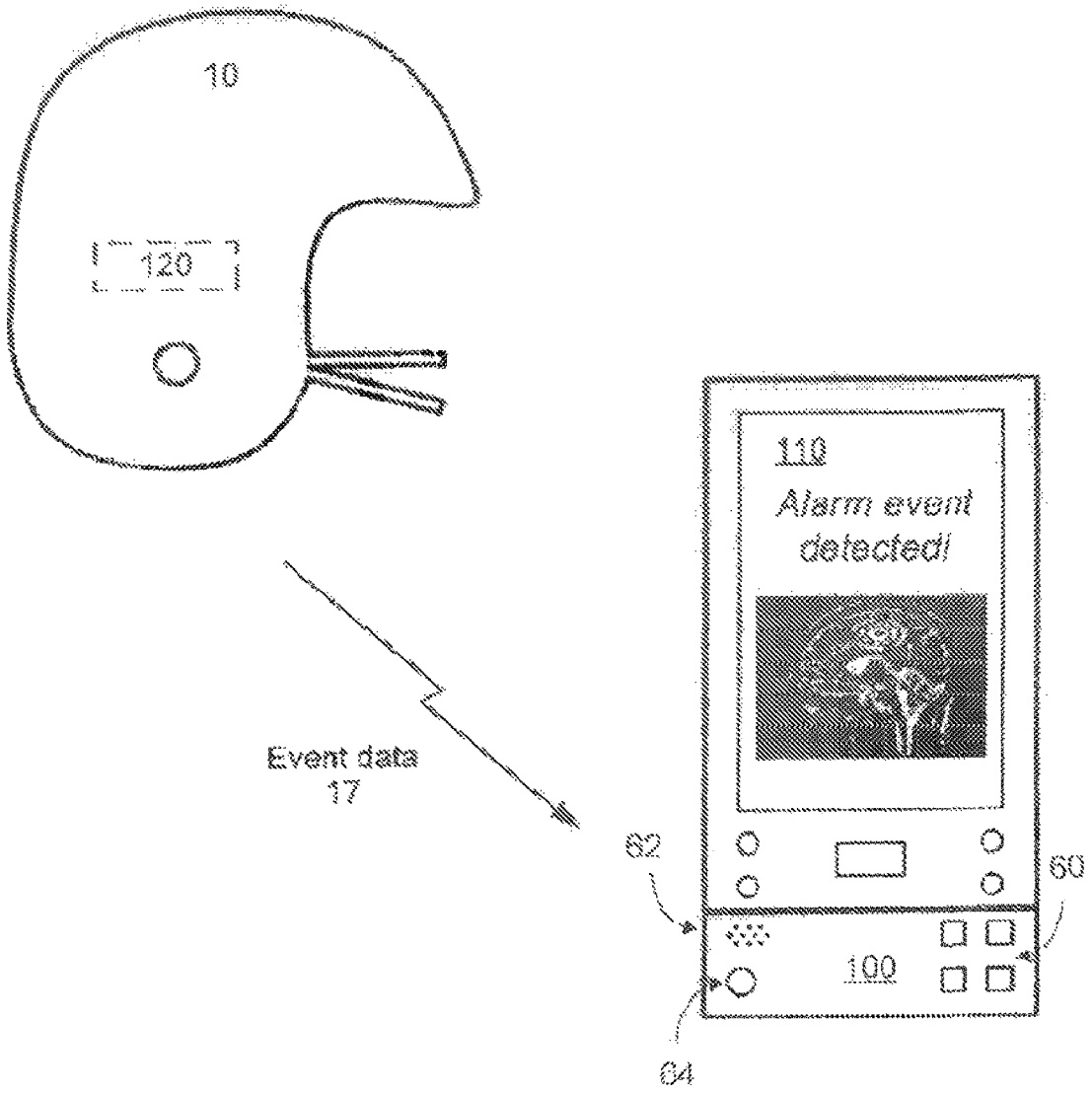
FIG. 22 presents a pictorial representation of a system for monitoring protective headgear in accordance with an embodiment of the present invention.

FIG. 22 presents a pictorial representation of a system for monitoring protective headgear in accordance with an embodiment of the present invention. In particular, a handheld communication device 110, such as a smart phone, digital book, netbook, personal computer with wireless data communication or other wireless communication device includes a wireless transceiver for communicating over a long range wireless network such as a cellular, PCS, CDMA, GPRS, GSM, iDEN or other wireless communications network and/or a short-range wireless network such as an IEEE 802.11 compatible network, a Wimax network, another wireless local area network connection or other communications link. Handheld communication device 110 is capable of engaging in wireless communications such as sending and receiving telephone calls and/or wireless data in conjunction with text messages such as emails, short message service (SMS) messages, pages and other data messages that may include multimedia attachments, documents, audio files, video files, images and other graphics. Handheld communication device 110 includes one or more processing devices for executing other applications and a user interface that includes, for example, buttons, a display screen such as a touch screen, a speaker, a microphone, a camera for capturing still and/or video images and/or other user interface devices.

A wireless device 120 is mounted in or otherwise coupled to a piece of protective headgear 10. The wireless device 120 includes a sensor module that generates sensor data in response to an impact to the protective headgear 10. Wireless device 120 further includes a short-range wireless transmitter that transmits a wireless signal, such as a radio frequency (RF) signal, magnetic signal, infrared (IR) signal or other wireless signal that includes data, such as event data 17 or other data that indicates, for example, data pertaining to an impact on the protective headgear. The short-range wireless transmitter can be part of a transceiver that operates in conjunction with a communication standard such as 802.11, Bluetooth, 802.15.4 standard running a ZigBee or other protocol stack, ultra-wideband, an RF identification (RFID), IR Data Association (IrDA), Wimax or other standard short or medium range communication protocol, or other protocol.

While protective headgear 10 is styled as a football helmet, the present invention can be implemented in conjunction with other protective headgear including a hat, headband, mouth guard or other headgear used in sports, a hard hat or other industrial protection gear, other headgear and helmets worn by public safety or military personnel or other headgear or helmets. In addition, protective headgear can include a face mask, face guard, skull cap, chin strap, an earpiece such as ear plugs, a hearing aide, an ear mounted transceiver, an ear piece in contact with the bony area of the skull behind the ear or other ear piece or other gear that is either a separate component or is integrated with other headgear or other gear. In particular, protective headgear includes, but is not limited to, gear that is used to reduce vibration, dissipate impact energy from an impact event, control the rate of energy dissipation in response to an impact event and/or to provide real-time or non-real-time monitoring and analysis of impact events to the region of the head and neck of a wearer of the protective gear.

Adjunct device 100 includes a housing that is coupleable to the handheld communication device 110 via a communication port of the handheld communication device 110. The adjunct device 100 includes a short-range wireless receiver that receives a wireless signal from the wireless device 120 that includes data, such as event data 17. The short-range wireless receiver of adjunct 100 can also be part of a transceiver that operates in conjunction with a communication standard such as 802.11, Bluetooth, 802.15.4 standard running a ZigBee or other protocol stack, ultra-wideband, Wimax or other standard short or medium range communication protocol, or other protocol. In particular, the short-range wireless receiver of adjunct device 100 is configured to receive the event data 17 or other data generated by wireless device 120.

Adjunct device includes its own user interface having push buttons 60, sound emitter 62 and light emitter 64 that optionally can emit audio and/or visual alert signals in response to the event data 17. As with the user interface of wireless device 120, the user interface of adjunct device 100 can similarly include other devices such as a touch screen or other display screen, a thumb wheel, trackball, and/or other input or output devices. While shown as a plug-in module, the adjunct device 100 can be implemented as either a wireless gateway or bridge device or a case or other housing that encloses or partially encloses the handheld communication device 100.

In operation, event data 17 is generated by wireless device 120 in response to an impact to the protective headgear 10. The event data 17 is transmitted to the adjunct device 100 that transfers the event data 17 to the handheld communication device 110 either wirelessly or via the communication port of the handheld communication device 110. The handheld communication device 110 executes an application to further process the event data 17 to, for example, display a simulation of the head and/or brain of the wearer of the protective headgear 10 as a result of the impact.

Figure 23:
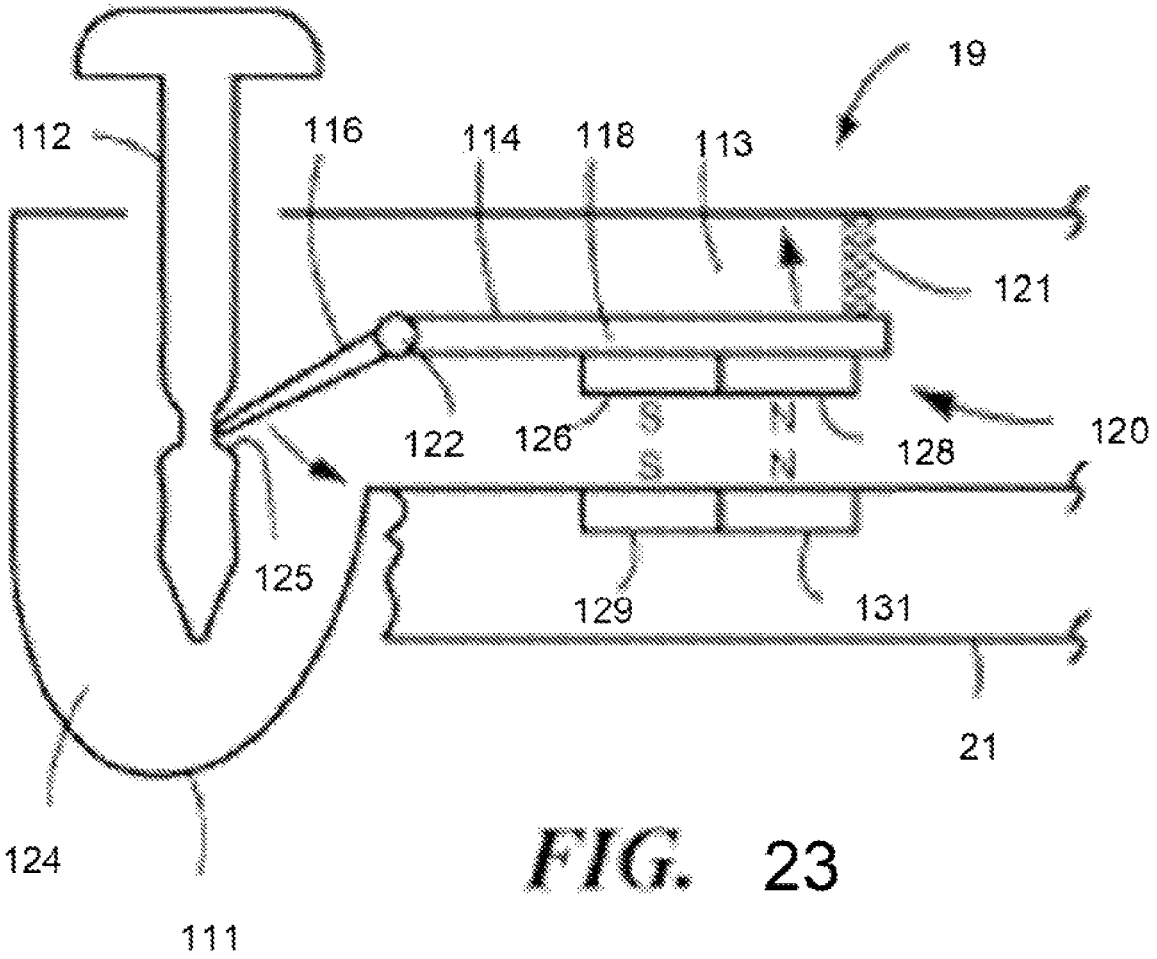
FIG. 23 is a side view of an exemplary magnetically actionable locking assembly constructed in accordance with the principles of the present invention.

FIG. 23 shows one embodiment of an attachment element 112 as a pin. Magnetic clamping system 19 includes the attachment element 112 to secure helmet 10 to the facemask 12. Attachment element 112 need not be a pin but can be any type of attachment device, such as a lanyard, a plunger or a plastic strap. Magnetic clamping system 19 includes a housing 111, and also includes a retaining part 114 situated within a clamping region 113 in housing 111. Retaining part 114 may be made of a magnetic material such as carbon steel or can be made of a non-magnetic material. Retaining part 114 acts as a magnetic clutch and secures attachment element 112 within an attachment region 124, thus preventing the unauthorized separation of the facemask 12 from the helmet 10. Retaining part 114 includes a locking region 116, a magnet location region 118, and a magnetic element 120. Spring 121 biases retaining part 114 to allow retention of attachment element 112 and to allow return of retaining part 114 to the locked position once the magnetic clamping system 19 has been unlocked. Although spring 121 is shown above retaining part 114 so that operation of retaining part 114 causes compression of spring 121, the invention is not limited to such. For example, it is contemplated that spring 121 can be placed below retaining part 114 such that operation of retaining part 114 causes an expansion of spring 121.

Locking region 116 and magnet location region 118 pivot about a pivot point 122, which allows locking region 116 to move between a first position and a second position. When in the first position, locking region 116 engages a circumferential detente 125 in attachment element 112, thus locking attachment element 112 in place within attachment region 124. When locking region 116 is in the first position, attachment element 112, in this instance a pin, prevents the unauthorized separation of the facemask 12 from the helmet 10. When magnet location region 118 moves in the direction of the arrow in FIG. 23, locking region 116 moves to a second position in the direction of the arrow and disengages with attachment element 112 thus allowing attachment element 112 to be withdrawn from attachment region 124 and the facemask 12 separated from the helmet 10. Magnetic element 120 includes at least one hard magnet affixed to one side of magnet location region 118 as shown in FIG. 23.

FIG. 23 also shows a magnetic detacher 21 used to detach a facemask 12 from a helmet 10. Magnetic detacher 21 includes one or more magnets 129 and 131 such that when magnetic detacher 21 is placed proximate to the magnetic clamping system 19, magnets 129 and 131 are aligned with the magnets of magnetic element 120 of magnetic clamping system 19. Due to the repelling force between magnets having identical outwards-facing poles, body 118 is forced in the direction of the arrow which in turn forces locking region 116 to pivot about pivot point 122. This disengages locking region 116 from within circumferential detente 125, which allows attachment element 112 to be detached. Thus, magnetic element 120 of the magnetic clamping system 19 has a magnetic arrangement forming a "key". Magnetic detacher 21 must include magnets having the corresponding magnetic "key" in order to detach attachment element 112 from the magnetic clamping system 19. A repelling force is generated upon magnets 126 and 128, which forces body 118 of clamp 114 upwards, as shown in FIG. 23.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention. Those skilled in the art will appreciate that the conception upon which this disclosure is based, may readily be utilized as a basis for designing of other structures, methods and systems for carrying out the several purposes of the present invention to instruct and encourage the avoidance of impacts to players where concussions and potential brain injuries may be encountered. It is important, therefore, that the claims be regarded as including any such equivalent construction insofar as they do not depart from the spirit and scope of the present invention.

What is claimed is:

1. A helmet comprising, a facemask having a facemask bar portion connected to the helmet by at least two quick release facemask connecting structures positioned on at least a left side and a right side of the helmet, wherein said at least two quick release facemask connecting structures include a coupler mechanism receiving said facemask bar portion to secure the facemask bar portion to the helmet, said coupler mechanism having a contoured exterior with a metal post movably retained in an interior of said coupler mechanism by a magnetically actionable locking assembly including a retaining part, said magnetically actionable locking assembly adapted to move from a first locked position to a second unlocked position when a magnetic force is applied to the contoured exterior in a manner that causes the metal post to move from a retained position to a non-retained position, wherein the non-retained position allows for detachment of the facemask bar portion from the helmet.

2. The helmet of claim 1, wherein said magnetically actionable locking assembly is adapted to move from said first locked position to said second unlocked position when the retaining part is attracted to the magnetic force, by employing magnets selected from the group consisting of a NdFeB magnet, a hard ferrite magnet, a SmCo magnet, and an AlNiCo magnet.

3. The helmet of claim 1, wherein the helmet further comprises a wireless device comprising a sensor module, coupled to the helmet, said sensor module adapted to generate sensor data in response to an impact to the helmet.

4. The helmet as set forth in claim 1, wherein when the magnetic force is applied, the metal post moves from the retained position to the non-retained position, and wherein the metal post comprises a pin.

5. The helmet as set forth in claim 1, wherein said helmet comprises an outer shell; an inner shell that is more rigid than the outer shell, said outer shell being more flexible than the inner shell; said helmet having at least one layer that includes an array of impact absorbing polygonal structures proximate to the outer shell and proximate to the inner shell, and at least one layer providing resistance to an impact force, said at least one layer comprising one or more of the following materials: thermoplastic polyurethane, an impact absorbing silicone, an energy-absorbing foam, a polymer gel, a shock-absorbing elastomer, a visco-elastic polymer, an impact dispersing gel, and shape memory material.

6. The helmet of claim 5, wherein the at least one layer comprises an energy absorbing foam.

7. The helmet of claim 5, wherein the at least one layer comprises a visco-elastic polymer.

8. The helmet of claim 5, wherein the at least one layer comprises an impact dispersing gel.

9. The helmet of claim 5, wherein the array of impact absorbing polygonal structures comprises a hexagonal structure.

10. The helmet of claim 5, wherein the at least one layer comprises a shape memory material.

11. The helmet of claim 5, wherein the array of impact absorbing polygonal structures comprise groups of hexagons.

12. The helmet of claim 5, wherein the magnetically actionable locking assembly has no rotating parts.

13. The helmet of claim 5, wherein the array of impact absorbing polygonal structures is flexible.

14. The helmet of claim 5, wherein the at least one layer comprises a thermoplastic polyurethane material.

15. A helmet comprising an outer shell; an inner shell that is more rigid than the outer shell, said outer shell being more flexible than the inner shell; said helmet having at least one layer that includes an array of impact absorbing structures proximate to the outer shell and proximate to the inner shell, and at least one layer providing resistance to an impact force, said at least one layer comprising one or more of the following materials: thermoplastic polyurethane, an impact absorbing silicone, an energy-absorbing foam, a polymer gel, a shock-absorbing elastomer, a visco-elastic polymer, an impact dispersing gel, and shape memory material, and a facemask having a facemask bar portion connected to the helmet by at least two quick release facemask connecting structures positioned on at least a left side and a right side of the football helmet, said at least two quick release facemask connecting structures including a coupler mechanism adapted to receive said facemask bar portion to secure the facemask bar portion to the helmet, said coupler mechanism having a exterior with a metal post movably retained in an interior of said coupler mechanism by a magnetically actionable locking assembly including a retaining part, said magnetically actionable locking assembly adapted to move from a first locked position to a second unlocked position when a magnetic force is applied to the exterior in a manner that causes the metal post to move from a retained position to a non-retained position, wherein the non-retained position allows for detachment of the facemask bar portion from the helmet, and wherein the retaining part of the magnetically actionable locking assembly is adapted to be attracted to a magnetic force that pulls the retaining part from the first locked position to move the post;

wherein said at least one layer comprises a shock-absorbing elastomer adapted to withstand the shock of an impact force without permanent deformation; and wherein the helmet comprises a wireless device comprising a sensor module, coupled to the helmet, said sensor module adapted to generate sensor data in response to an impact to the helmet.

16. The helmet of claim 15, wherein the at least one layer comprises two different elastomer materials, each having different densities to reduce single direction compressive shock forces.

17. The helmet of claim 15, wherein the at least one layer comprises an energy absorbing foam.

18. A helmet comprising an outer shell; an inner shell that is more rigid than the outer shell, said outer shell being more flexible than the inner shell; said helmet having at least one layer that includes an array of impact absorbing structures proximate to the outer shell and proximate to the inner shell, and at least one layer providing resistance to an impact force, said at least one layer comprising one or more of the following materials: thermoplastic polyurethane, an impact absorbing silicone, an energy-absorbing foam, a polymer gel, a shock-absorbing elastomer, a visco-elastic polymer, an impact dispersing gel, and shape memory material, and a facemask having a facemask bar portion connected to the helmet by at least two quick release facemask connecting structures positioned on at least a left side and a right side of the helmet, said at least two quick release facemask connecting structures including a coupler mechanism adapted to receive said facemask bar portion to secure the facemask bar portion to the helmet, said coupler mechanism having a contoured exterior with a metal post movably retained in an interior of said coupler mechanism by a magnetically actionable locking assembly including a retaining part, said magnetically actionable locking assembly adapted to move from a first locked position to a second unlocked position when a magnetic force is applied to the contoured exterior in a manner that causes the metal post to move from a retained position to a non-retained position, wherein the non-retained position allows for detachment of the facemask bar portion from the helmet, said magnetically actionable locking assembly including a metallic spring adapted to be attracted to a magnetic force that pulls the metallic spring away from a first position to move the post;

wherein said at least one layer comprises a shock-absorbing elastomer adapted to withstand the shock of an impact force without permanent deformation.

19. The helmet of claim 18, wherein the at least one layer comprises two different elastomer materials, each having different densities to reduce single direction compressive shock forces.

20. The helmet as set forth in claim 18, wherein the at least one layer comprises an impact dispersing gel.

* * * * *